US010884363B2

(12) United States Patent
Aoki

(10) Patent No.: US 10,884,363 B2
(45) Date of Patent: Jan. 5, 2021

(54) IMAGE FORMING APPARATUS

(71) Applicant: CANON KABUSHIKI KAISHA, Tokyo (JP)

(72) Inventor: Kohei Aoki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/833,920

(22) Filed: Dec. 6, 2017

(65) Prior Publication Data

US 2018/0164722 A1 Jun. 14, 2018

(30) Foreign Application Priority Data

Dec. 13, 2016 (JP) ..... 2016-241332
Oct. 4, 2017 (JP) ..... 2017-194426

(51) Int. Cl.
*G03G 15/20* (2006.01)
*G03G 15/00* (2006.01)

(52) U.S. Cl.
CPC ..... *G03G 15/2053* (2013.01); *G03G 15/2017* (2013.01); *G03G 15/55* (2013.01); *G03G 2215/00143* (2013.01); *G03G 2221/1657* (2013.01)

(58) Field of Classification Search
CPC ..... G03G 15/755; G03G 2215/00143; G03G 2215/00151; H02P 8/38
See application file for complete search history.

(56) References Cited

U.S. PATENT DOCUMENTS 4,716,286 A * 12/1987 Taylor ..... B65H 7/00 250/214 R
6,607,458 B2 * 8/2003 Downing ..... B41J 11/007 399/165
2003/0129000 A1 * 7/2003 Lee ..... G03G 15/755 399/165
2010/0158553 A1 * 6/2010 Ueno ..... G03G 15/2064 399/67
2014/0139173 A1 * 5/2014 You ..... H02P 8/38 318/696

FOREIGN PATENT DOCUMENTS

CN 101763014 A 6/2010
CN 103853019 A 6/2014
JP H069096 A 1/1994
JP 2015059964 A 3/2015

* cited by examiner

*Primary Examiner* — Noam Reisner
(74) *Attorney, Agent, or Firm* — Canon U.S.A., Inc. IP Division

(57) ABSTRACT

An image forming apparatus includes a belt rotating member forming, with the rotating member, a nip portion for fixing a toner image to the recording medium, first and second rollers rotatably supporting the belt rotating member, a stepping motor tilting the first roller, an output unit outputting an amount-of-rotation signal instructing an amount of rotation of a rotor in the stepping motor, an electric current control unit controlling electric current to be fed to a coil in the stepping motor based on the amount-of-rotation signal, and a notifying unit. The notifying unit provides a predetermined notification in a state that an image formation process can be executed based on an output from a detecting unit configured to detect a position of the first roller and a value counted by a measuring unit counting the amount of rotation instructed by the output unit.

8 Claims, 14 Drawing Sheets

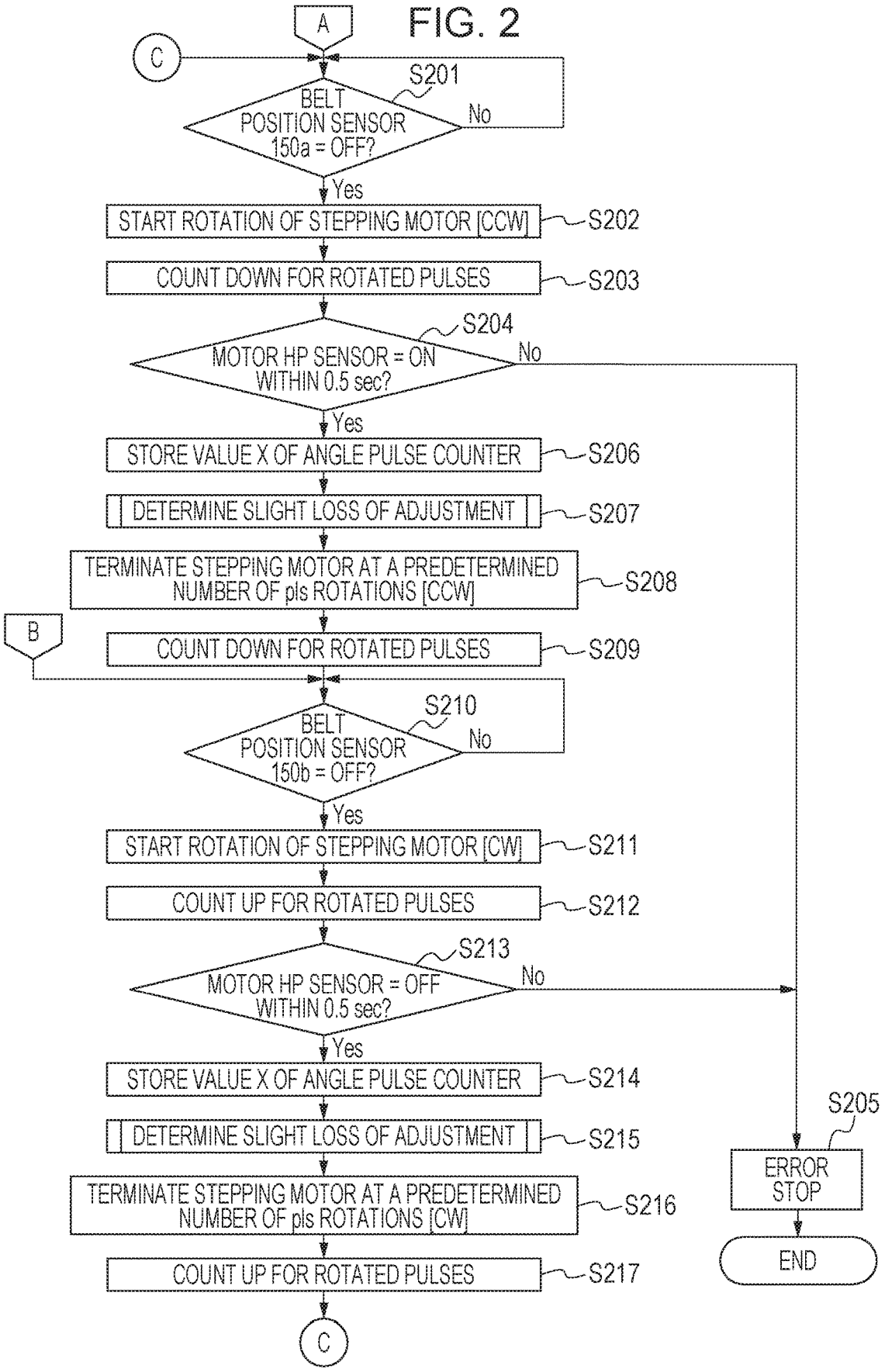
FIG. 2
A
C
S201
BELT POSITION SENSOR 150a = OFF?
No
Yes
START ROTATION OF STEPPING MOTOR [CCW]
S202
COUNT DOWN FOR ROTATED PULSES
S203
S204
MOTOR HP SENSOR = ON WITHIN 0.5 sec?
No
Yes
STORE VALUE X OF ANGLE PULSE COUNTER
S206
DETERMINE SLIGHT LOSS OF ADJUSTMENT
S207
TERMINATE STEPPING MOTOR AT A PREDETERMINED NUMBER OF pls ROTATIONS [CCW]
S208
B
COUNT DOWN FOR ROTATED PULSES
S209
S210
BELT POSITION SENSOR 150b = OFF?
No
Yes
START ROTATION OF STEPPING MOTOR [CW]
S211
COUNT UP FOR ROTATED PULSES
S212
S213
MOTOR HP SENSOR = OFF WITHIN 0.5 sec?
No
Yes
STORE VALUE X OF ANGLE PULSE COUNTER
S214
DETERMINE SLIGHT LOSS OF ADJUSTMENT
S215
TERMINATE STEPPING MOTOR AT A PREDETERMINED NUMBER OF pls ROTATIONS [CW]
S216
COUNT UP FOR ROTATED PULSES
S217
C
S205
ERROR STOP
END

FIG. 9

| POSITION OF PRESSURE BELT 120 | +3.0 mm | +1.5 mm | -1.5 TO +1.5 mm | -1.5 mm | -3.0 mm |
|---|---|---|---|---|---|
| | BACKSIDE | | MIDDLE | FRONT SIDE | |
| | MOVEMENT RESTRICTING POSITION → TERMINATE APPARATUS | ANGLE CHANGING POSITION | IN DEVIATING OPERATION | ANGLE CHANGING POSITION | MOVEMENT RESTRICTING POSITION → TERMINATE APPARATUS |
| BELT POSITION SENSOR 150a (FRONT SIDE) | OFF | ON | ON | OFF | OFF |
| BELT POSITION SENSOR 150b (BACKSIDE) | OFF | OFF | ON | ON | OFF |
| DIRECTION OF ROTATION OF STEPPING MOTOR 155 | | CW | - | CCW | |

IMAGE FORMING APPARATUS

BACKGROUND

Field of the Disclosure

The present disclosure relates to an electrophotographic image forming apparatus.

Description of the Related Art

An electrophotographic image forming apparatus includes a fixing device configured to apply heat and pressure to an unfixed toner image on a recording medium to fix the toner image to the recording medium. A known fixing device may have a pair of rotating members forming a nip portion, and one or both of the rotating members may be an endless belt.

Japanese Patent Laid-Open No. 2015-59964 discloses a configuration in a stepping motor drives an end of one steering roller of a plurality of rollers across which a belt is put to be tilted for reciprocally moving the belt within a certain range in a lateral direction. Japanese Patent Laid-Open No. 2015-59964 further discloses a configuration which, in a case where a control for reciprocally moving a belt is disabled and the belt is positioned at its end in a lateral direction beyond a certain range, the image forming apparatus determines occurrence of a malfunction and stops a rotating movement of the belt in a fixing device.

One cause for disability of the control for reciprocal movement of the belt may be a loss of synchronization of a stepping motor for driving a steering roller.

However, in the configuration according to Japanese Patent Laid-Open No. 2015-59964, the image forming apparatus determines occurrence of a malfunction after the control for reciprocally moving the belt is disabled. As a result, a user may not recognize the occurrence of the malfunction relating to the control for reciprocally moving the belt until rotation of the belt is stopped. This may possibly cause inconvenience or delayed recognition of the malfunction.

SUMMARY

Accordingly, the present disclosure provides an apparatus for improving notification about malfunction.

An image forming apparatus includes an image forming unit configured to form a toner image on a recording medium, a rotating member, an endless belt rotating member configured to form, in cooperation with the rotating member, a nip portion configured to fix the toner image formed by the image forming unit to the recording medium, a first roller and a second roller configured to rotatably support the belt rotating member, a stepping motor, a drive transmitting unit configured to transmit drive of the stepping motor to the first roller so as to tilt the first roller, an output unit configured to output an amount-of-rotation signal instructing an amount of rotation of a rotor in the stepping motor, an electric current control unit configured to control electric current to be fed to a coil in the stepping motor based on the amount-of-rotation signal output from the output unit, a measuring unit configured to count the amount of rotation instructed by the output unit, a detecting unit configured to detect a position of the first roller, and a notifying unit configured to provide a predetermined notification based on the output from the detecting unit and a value counted by the measuring unit, the notifying unit providing the predetermined notification in a state that an image formation process can be executed.

An image forming apparatus includes an image forming unit configured to form a toner image on a recording medium, a rotating member, an endless belt rotating member configured to form, in cooperation with the rotating member, a nip portion configured to fix the toner image formed by the image forming unit to the recording medium, a first roller and a second roller configured to rotatably support the belt rotating member, a stepping motor, a drive transmitting unit configured to transmit drive of the stepping motor to the first roller so as to tilt the first roller, a detecting unit configured to detect a position of the first roller, and an output unit configured to output an amount-of-rotation signal instructing an amount of rotation of a rotor in the stepping motor and a rotation direction signal instructing a rotation direction of the rotor. In this case, the output unit outputs the amount-of-rotation signal and the rotation direction signal such that a first period, a second period, a third period and a fourth period can be repeated in this order. In the first period, the rotor is rotated by a predetermined amount of rotation in a first rotation direction from a state having the first roller placed at a predetermined position. In the second period, the rotor is rotated in a second rotation direction opposite to the first rotation direction from a position having the first roller moved by drive of the stepping motor in the first period until the detecting unit detects that the first roller is placed at the predetermined position. In the third period, the rotor is further rotated in the second rotation direction. In the fourth period, the rotor is rotated in the first direction until the first roller is placed at a predetermined position. The image forming apparatus further includes an electric current control unit configured to control electric current to be fed to a coil in the stepping motor based on the amount-of-rotation signal and the rotation direction signal output from the output unit, a measuring unit configured to measure a time period from a time when the output unit instructs rotation in the second direction to a time when the detecting unit detects that the first roller is placed at the predetermined in the second period, and a notifying unit configured to provide a predetermined notification based on the time period measured by the measuring unit, the notifying unit providing the predetermined notification in a state that an image formation process can be executed.

Further features of the present disclosure will become apparent from the following description of exemplary embodiments with reference to the attached drawings.

BRIEF DESCRIPTION OF THE DRAWINGS

FIG. 2 is a flowchart relating to a control over a stepping motor, in accordance with an embodiment of the subject disclosure.

FIG. 9 is a table illustrating example correspondences between positions of a belt and signals from a belt position sensor, in accordance with an embodiment of the subject disclosure.

DESCRIPTION OF THE EMBODIMENTS

Embodiments of the present disclosure will be described in detail below with reference to the attached drawings. It is to be understood that components according to the embodiments are given for illustration purpose only, and it is not intended that the present disclosure is limited by the components of the embodiments.

First Embodiment

Image Forming Apparatus

Figure 4:
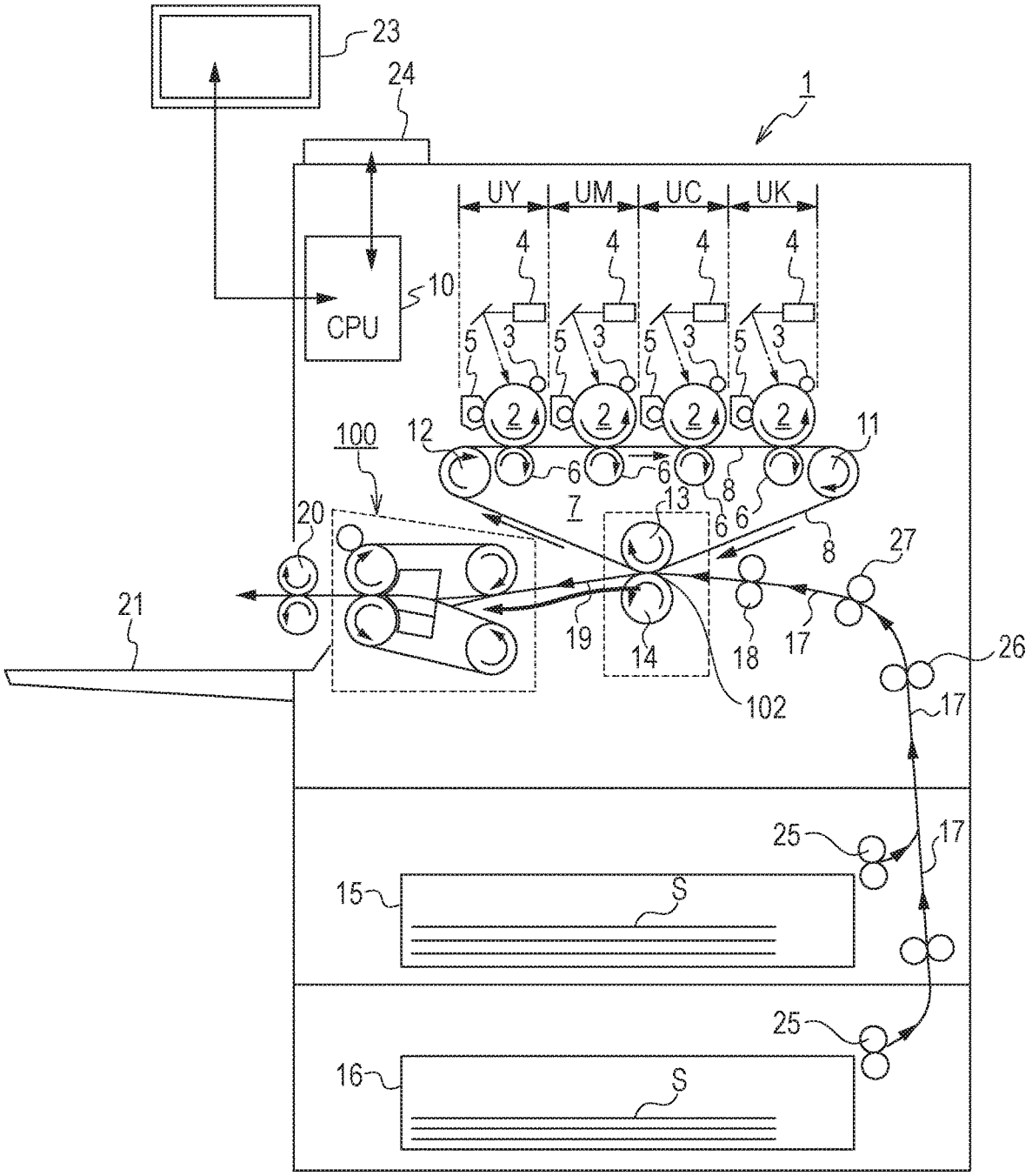
FIG. 4 illustrates an example image forming apparatus, in accordance with an embodiment of the subject disclosure.

FIG. 4 illustrates an example image forming apparatus. An image forming apparatus 1 has four image forming units U (UY, UM, UC, UK) of yellow (Y), magenta (M), cyan (C), and black (K). To avoid complicated descriptions, the four image forming units of Y, M, C, and K are represented by reference "U" in the following descriptions, and the same is true in descriptions of associated processing units. The order of arrangement of the image forming units U of colors of Y, M, C, and K is not limited thereto. In each of the image forming units U, a photoconductive drum (image bearing member) 2 is electrostatically charged by a charging roller 3. A laser scanner 4 causes the photoconductive drum 2 to expose to a laser beam so that an electrostatic latent image can be formed on the photoconductive drum 2. The electrostatic latent image to be formed here corresponds to image information input from an external host apparatus 23 to a CPU (central processing unit) 10. The electrostatic latent image formed on the photoconductive drum 2 is developed by a developing device 5 by using toners. The toner images formed on the photoconductive drum 2 by the developing device 5 are sequentially transferred by a primary transfer roller 6 onto an intermediate transfer belt 8. Thus, a full-color toner image is formed on the intermediate transfer belt 8.

On the other hand, cassettes 15 and 16 contain sheets (recording media) S. A sheet S in the cassette 15 or 16 is conveyed through a conveying path 17 by a feeding roller 25, conveyance rollers 26 and 27, and a registration roller 18 to a transfer nip portion 102 formed by the intermediate transfer belt 8 and a secondary transfer roller 14. The intermediate transfer belt 8 is sandwiched between a roller 13 and the secondary transfer roller 14 at the transfer nip portion 102. The toner image on the intermediate transfer belt 8 undergoes secondary transfer to the sheet S conveyed to the transfer nip portion 102. The sheet S to which the toner image has been transferred is conveyed to a fixing device 100 through a conveying path 19. The sheet S is heated and pressed in the fixing device 100. Thus, the toner image on the sheet S (recording medium) is fixed to the sheet S. The sheet S fixed by the fixing device 100 is discharged to an external discharge tray 21 by a discharge roller 20.

According to this embodiment, the image forming apparatus 1 is an example apparatus having a full-color, intermediate transfer image forming unit. However, embodiments of the present disclosure are not limited thereto. For example, it may be a direct transfer apparatus which directly transfers a toner image from the photoconductive drum 2 to a sheet S without through the intermediate transfer belt 8, which will be described below, or may be an apparatus (such as a monochromatic image forming apparatus for forming black-and-white monochromatic toner image, for example). The image forming apparatus 1 may be a copier, a printer, a facsimile apparatus, or a multi-functional peripheral including a plurality of functions.

Fixing Device

Figure 5:
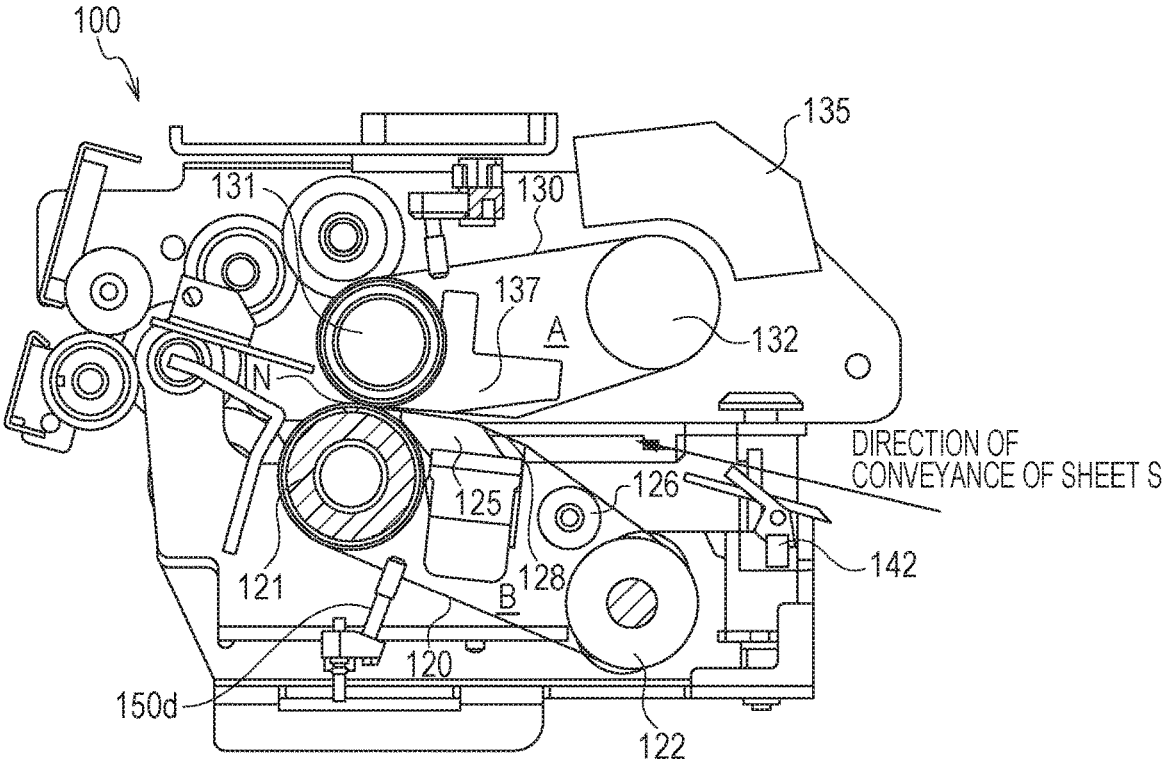
FIG. 5 illustrates an example fixing device, in accordance with an embodiment of the subject disclosure.
Figure 6:
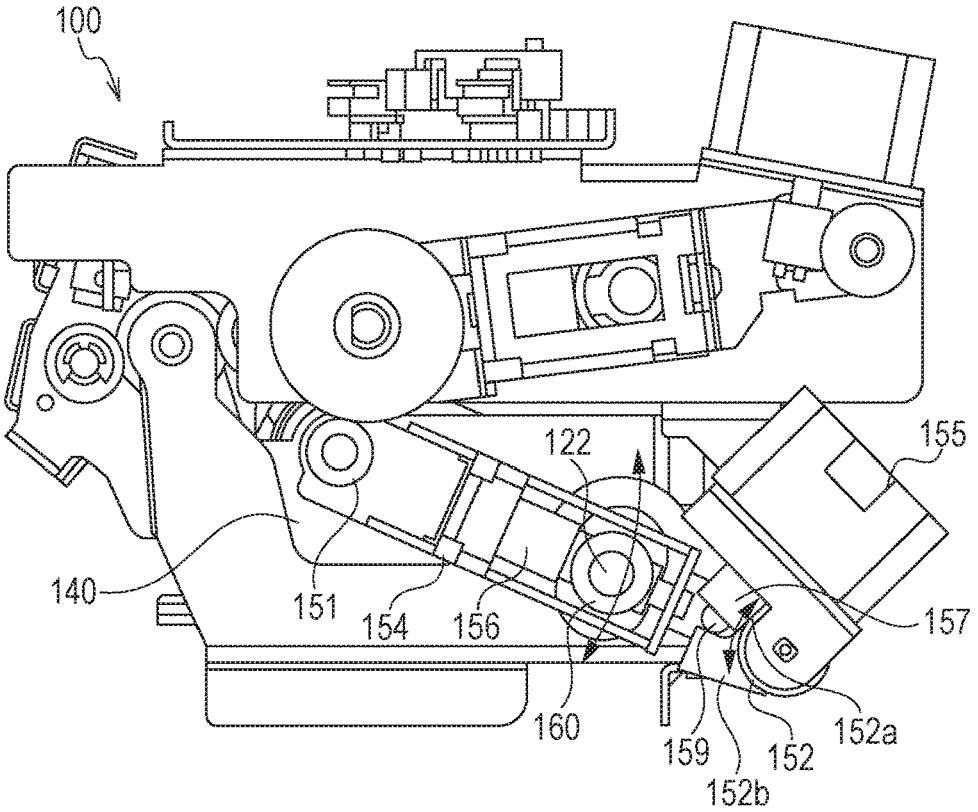
FIG. 6 is a side view illustrating the example fixing device, in accordance with an embodiment of the subject disclosure.

Next, with reference to FIGS. 5 and 6, a configuration of the fixing device 100 will be described. FIG. 5 illustrates an example fixing device. FIG. 6 is a front side view of the example fixing device. Here, in descriptions of this embodiment, the term "front side" refers to a side having the conveying direction for a sheet S in the fixing device 100 from right to left, viewing the fixing device 100 from the axial direction of the driving roller 131. A term "back side" refers to a side having the conveying direction for a sheet S in the fixing device 100 from left to right, viewing the fixing device 100 from the axial direction of the driving roller 131.

A heating belt 130 and a pressure belt 120 form a fixing nip portion (nip portion) N for fixing a toner image on a sheet S by nipping and conveying the sheet S in cooperation.

The pressure belt 120 may be an endless belt rotating member (rotating member) and is rotatably supported by two rollers including a pressing roller 121 and a tension roller 122. The tension roller 122 is urged by a sprint and applies tension to the pressure belt 120. Thus, the pressure belt 120 can be put across under a predetermined amount of tensile force (such as 200 N).

The pressure belt 120 may be made of any heat-resistant material. For example, the pressure belt 120 may be formed by coating 300 μm thick silicone rubber over a nickel metal layer having a thickness of 50 μm, a width of 380 mm, and a peripheral length of 200 mm, for example, and covering its surface layer with a PFA tube.

A pressure pad 125 is provided on an inner side of the pressure belt 120 corresponding to an inlet port side (upstream side of the pressing roller 121 in the conveying direction of a sheet S) of the fixing nip portion N formed by the pressure belt 120 and the heating belt 130 which are configured to nip and convey a sheet S. The pressure pad 125 may be made of silicone rubber, for example. The pressure pad 125 is pressed against the pressure belt 120 with a predetermined amount of force (such as 400 N), and the pressure pad 125 and the pressing roller 121 form the fixing nip portion N.

The pressing roller 121 is one roller over which the pressure belt 120 is suspended and may be a hollow stainless roller having an outer diameter of ϕ20, for example. The pressing roller 121 is placed on an outlet port side (downstream side of the pressure pad 125 in the (sheet S conveying direction) of the fixing nip portion N formed by the pressure belt 120 and the heating belt 130. The pressing roller 121 may internally have a heater.

The tension roller 122 is one roller over which the pressure belt 120 is suspended and may be a stainless hollow roller, for example having an outer diameter of ϕ20 and an inner diameter of ϕ18. The tension roller 122 may also function as a steering roller configured to perform a steering operation for adjusting meandering of the pressure belt 120 in a lateral direction (or longitudinal direction of the pressing roller 121). The steering operation will be described below in detail.

Figure 8:
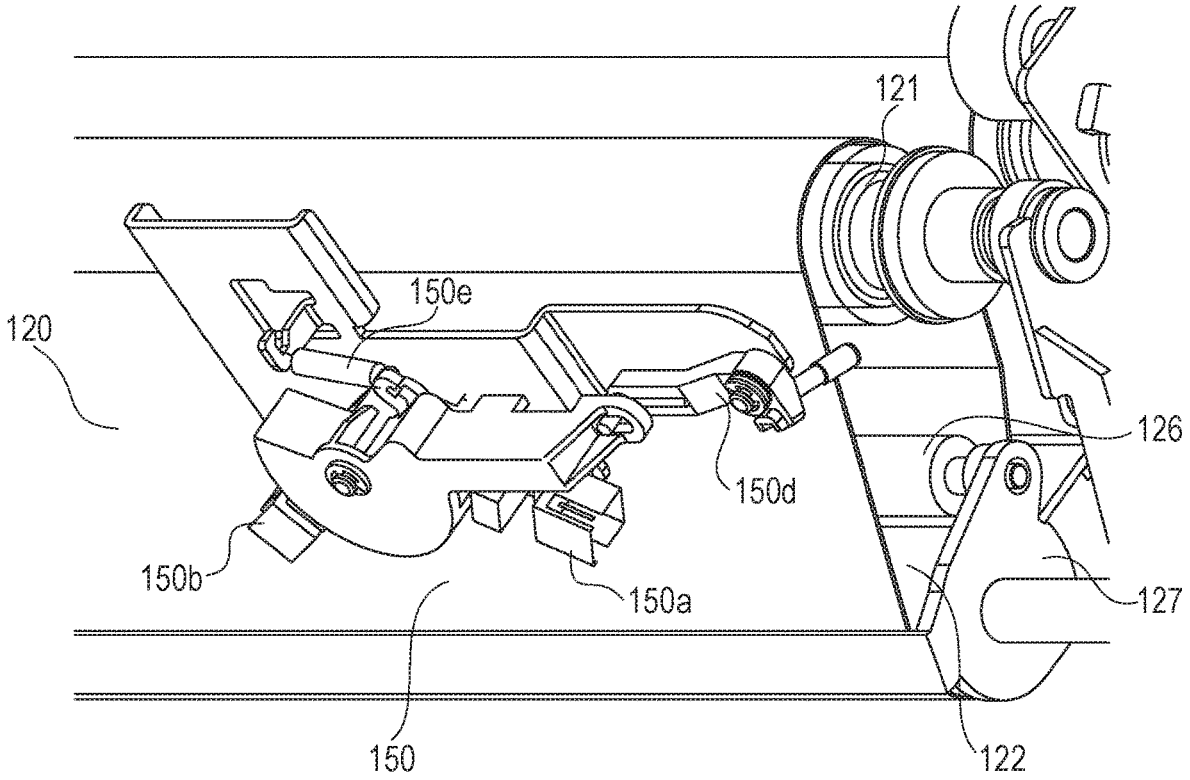
FIG. 8 illustrates an example belt position detecting unit, in accordance with an embodiment of the subject disclosure.

An oil applying roller (lubricant applying member) 126 is placed between the pressure pad 125 and the tension roller 122 and is configured to apply oil as a lubricant to an inner surface of the pressure belt 120. The oil applying roller 126 has both ends supported by an arm 127 (FIG. 8). The arm 127 is supported by the tension roller 122 and is rotatable about an axis of the tension roller 122. The arm 127 is connected to an urging unit, not illustrated, such as a spring, and the oil applying roller 126 is abutted against the inner surface of the pressure belt 120.

The heating belt 130 may be an endless belt rotating member (rotating member). The heating belt 130 is rotatably supported by a tension roller 132 and two rollers which gives tension to the driving roller 131 and the heating belt 130. The tension roller 132 is urged by a spring and gives tension to the heating belt 130. Thus, the heating belt 130 can be put across under a predetermined tensile force (such as 200 N).

The heating belt 130 may be formed by coating 300 μm thick silicone rubber over a metal layer such as a nickel metal layer or a stainless layer having a thickness of 75 m, a width of 380 mm, and a peripheral length of 200 mm, for example, and covering its surface layer with a PFA tube.

The heating belt 130 may be brought into contact with a surface having an unfixed toner image of a sheet S. The heating belt 130 may be heated by an IH heater (induction heating apparatus) 135 and may use the heat to heat the toner image on the sheet S.

A pad stay 137 made of, for example, stainless steel (or a SUS material) is provided on the inner side of the heating belt 130 corresponding to the inlet port side of the fixing nip portion N formed by the heating belt 130 and the pressure belt 120. The pad stay 137 is pressed against the pressure pad 125 with a predetermined amount of pressure (such as 400 N), and the pad stay 137 and the driving roller 131 form a fixing nip portion N.

The driving roller 131 may be a roller having, for example, a cored bar being a solid stainless roller having an outer diameter of ϕ18 and a heat-resistant silicone rubber elastic layer on a surface layer of the cored bar. The driving roller 131 is placed on the outlet port side of the fixing nip portion N formed by the heating belt 130 and the pressure belt 120. The elastic layer of the driving roller 131 is elastically distorted by pressure contact with the pressing roller 121 so that the driving roller 131 can carry a part of the fixing nip portion N.

The tension roller 132 may be, for example, a stainless hollow roller having an outer diameter of ϕ20 and an inner diameter of ϕ18 approximately. The tension roller 132 may also function as a steering roller configured to perform a steering operation for adjusting meandering of the heating belt 130 in a lateral direction (or longitudinal direction of the driving roller 131).

The driving roller 131 is driven by a drive motor 603 (FIG. 13) to rotate. The heating belt 130 is rotated by the rotating driving roller 131. The pressure belt 120 rotates by following the heating belt 130. Thus, the heating belt 130 and the pressure belt 120 can convey a sheet S in a stable manner.

Steering Operation and Control for Reciprocal Movement of Belt

Figure 7:
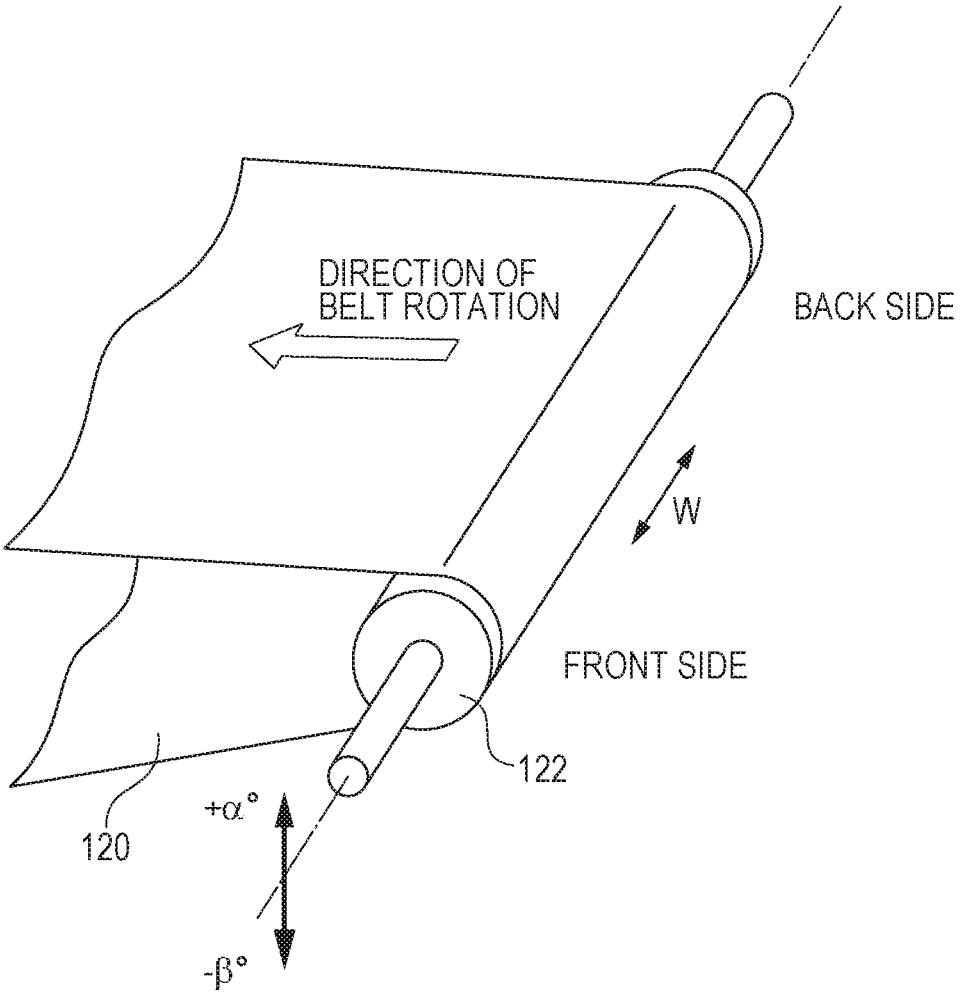
FIG. 7 illustrates a steering operation for a control for reciprocally moving a belt, in accordance with an embodiment of the subject disclosure.
Figure 11A:
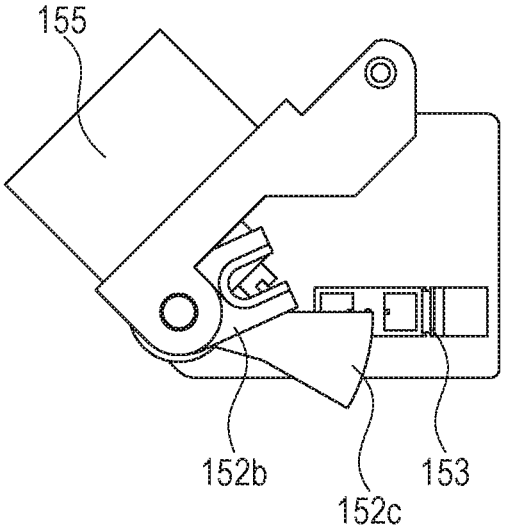
FIGS. 11A and 11B illustrate a mechanism relating to a steering operation, in accordance with an embodiment of the subject disclosure.
Figure 11B:
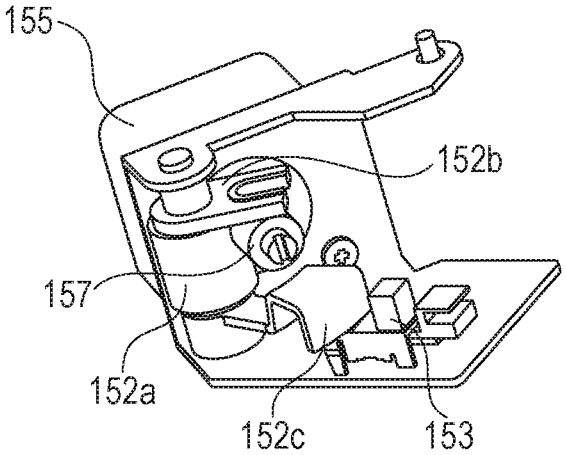

Next, with reference to FIGS. 5 to 8 and FIGS. 11A and 11B, a steering operation and control for reciprocally moving a belt will be described. FIG. 7 illustrates a steering operation for a control for reciprocally moving a belt. FIG. 8 illustrates an example belt position detecting unit. FIG. 11A illustrates a control arm 152, a worm 157, and a stepping motor 155 provided on the front side in the longitudinal direction of the tension roller 122, viewed from the back side. FIG. 11B is perspective views of the control arm 152, the worm 157, and the stepping motor 155.

A control for reciprocally moving the pressure belt 120 will be exemplarily described with respect to a belt reciprocal movement control, a steering operation, and determination of a slight loss of synchronization.

The fixing device 100 has a sensor unit 150 in neighborhood of a front end of the fixing device 100 with respect to the lateral direction of the pressure belt 120. The sensor unit 150 is configured to detect a position of the pressure belt 120. The sensor unit 150 will be described in detail below.

The sensor unit 150 is configured to detect a position of an end of the pressure belt 120. The CPU 10 tilts (steering operation) the tension roller 122 about the pressing roller 121 based on detection result (output) to control movement (laterally deviation) of the pressure belt 120 in the lateral direction. The CPU 10 performs a control such that the pressure belt 120 can move reciprocally within a predetermined region between one end and the other end in the lateral direction (belt reciprocal movement control).

In other words, the sensor unit 150 is configured to detect that the pressure belt 120 is off a predetermined zone in the lateral direction of the pressure belt 120. The CPU 10 in response to detection by the sensor unit 150 of a fact that the pressure belt 120 is off the predetermined zone tilts the tension roller 122 in the direction that the pressure belt 120 can return to the predetermined zone. Referring to the example in FIG. 10, the predetermined zone corresponds to a ±1.5 mm range.

More specifically, under the belt reciprocal movement control, when it is detected that the pressure belt 120 laterally deviating toward one end (such as front end) is located at a predetermined position at the one end (front side), the stepping motor 155 is driven to rotate for a predetermined number of rotations. Thus, the tension roller 122 is tilted in a direction that the pressure belt 120 can laterally deviate to the other end (back side). When the pressure belt 120 is rotated in the state, the pressure belt 120 laterally deviates to the other end side (back side). When the pressure belt 120 laterally deviating toward the other end side (back side) is placed at a predetermined position on the other end side (back side), the stepping motor 155 is driven to rotate for a predetermined number of rotations. Thus, the tension roller 122 is tilted in a direction that the pressure belt 120 can laterally deviate toward the one end side (front side). When the pressure belt 120 is rotated in the state, the pressure belt 120 laterally deviates toward the one end side (front side). As a result of repetition of these operations, the pressure belt 120 is controlled to reciprocally move within the predetermined region in the lateral direction. Here, the position of the pressure belt 120 is detected by the sensor unit 150, which will be described below.

Steering Operations and Motor HP Sensor

A mechanism for performing the steering operations will be described. The tension roller 122 is a steering roller configured to tilt the tension roller 122 by performing steering operations. A support arm 154 (FIG. 6) is an arm supporting an end of the tension roller 122 and is supported rotatably about an outer axis 151 (fulcrum) of the side plate 140 in the fixing device 100. The axis 151 is an axis of rotation of the pressing roller 121 and is fixed rotatably to the side plate 140. The tension roller 122 has a bearing 153 supporting the tension roller 122 rotatably and slidably in a direction of the tension of the belt. In order to apply tension to the pressure belt 120, the support arm 154 holds a tension spring 156 which urges a bearing 160 in the tension roller 122 in the direction of the tension of the belt. Because of the tension spring 156, a tension of 200 N is applied to the pressure belt 120.

The tension roller 122 further has a support arm 154 fixed to a drive axis 159. The drive axis 159 is connected to a control arm 152 to be driven by the stepping motor 155. The control arm 152 driven by the stepping motor 155 rotates the drive axis 159 to rotate the support arm 154. This can tilt the tension roller 122 supported by the support arm 154.

The control arm 152 has a gear unit 152*a* (FIGS. 11A and 11B) and an arm unit 152*b* supporting the drive axis 159. The gear unit 152*a* is engaged with the worm 157 which can be rotationally driven by the stepping motor 155. The stepping motor 155 is a drive motor configured to perform a steering operation.

Here, the support arm 154, the worm 157, and the control arm 152 (gear unit 152*a* and arm unit 152*b*) function as a drive transmitting unit configured to transmit drive of the stepping motor 155 to the tension roller 122.

The tension roller 122, the support arm 154, the drive axis 159, the worm 157, the control arm 152 (gear unit 152*a* and arm unit 152*b*), and the stepping motor 155 are mechanisms configured to perform steering operations. The CPU 10 controls rotations of the stepping motor 155 to cause the mechanisms to operate so that a belt reciprocal movement control can be performed which moves the pressure belt 120 in a lateral direction orthogonal to the conveying direction for a sheet S.

Next, with reference to FIGS. 11A and 11B, configurations of the control arm 152, the worm 157, and the stepping motor 155 will be described in regard to steering operations.

The worm 157 is held at a rotation axis (motor axis) 155*d* (FIGS. 12A and 12B) of the stepping motor 155, and the worm 157 rotates along with the rotation axis 155*d*. The worm 157 rotates to turn the gear unit 152*a* of the control arm 152. The arm unit 152*b* turns integrally with the gear unit 152*a* so that the drive axis 159 of the support arm 154 can be turned. Thus, the tension roller 122 can perform a steering operation in a first direction.

When the stepping motor 155 rotates in the opposite direction, the control arm 152 turns in the opposite direction, and the tension roller 122 also turns in the opposite direction. Thus, the tension roller 122 performs a steering operation in the direction opposite to the first direction.

In other words, the stepping motor 155 generates driving force for reciprocally moving the control arm 152, and the reciprocal movement of the control arm 152 causes the tension roller 122 to reciprocally move.

The fixing device 100 includes a motor HP sensor 153 functioning as a detecting unit configured to detect the position of the tension roller 122 for control over the amount of movement of the tension roller 122 in the steering operation.

More specifically, the control arm 152 has a motor flag 152*c* attached thereto which moves integrally with the control arm 152. The motor HP sensor (detecting unit) 153 is a sensor configured to detect a home position (HP) to be referred for operations of the stepping motor 155. For example, a transmission optical sensor may be used. An OFF signal is detected when the motor flag 152*c* shields the light-receiving unit in the motor HP sensor 153. An ON signal is detected if the motor flag 152*c* does not shield the light-receiving unit in the motor HP sensor 153. The CPU 10 determines as a home position a point where the ON/OFF state of the motor HP sensor 153 is switched with rotations of the stepping motor 155.

The motor HP sensor 153 is placed so as to have the home position within a range where a steering operation reciprocally moves the control arm 152. According to this embodiment, the motor HP sensor 153 is placed such that the center position of the range where the steering operation reciprocally moves the control arm 152 can be the home position.

Having described that, according to this embodiment, the configuration having the motor flag 152*c* in the control arm 152 as an example, the placement of the motor flag 152*c* is not limited thereto. The motor flag 152*c* may be placed on a drive transmission path from the rotation axis 155*d* of the stepping motor 155 to the tension roller 122. In other words, the detecting unit configured to detect the position of the tension roller 122 may be configured to be able to detect a reference position of the tension roller 122 which moves by following rotations of a rotor of the stepping motor 155. In other words, the detecting unit may be configured to be able to detect a position of a member that moves by following rotations of a rotor of the stepping motor 155, which is for moving the tension roller 122.

Stepping Motor

A stepping motor is a motor having a rotor which rotates by an amount of rotation (total angle of rotation) based on the number of pulses of an input pulse signal.

Figure 12A:
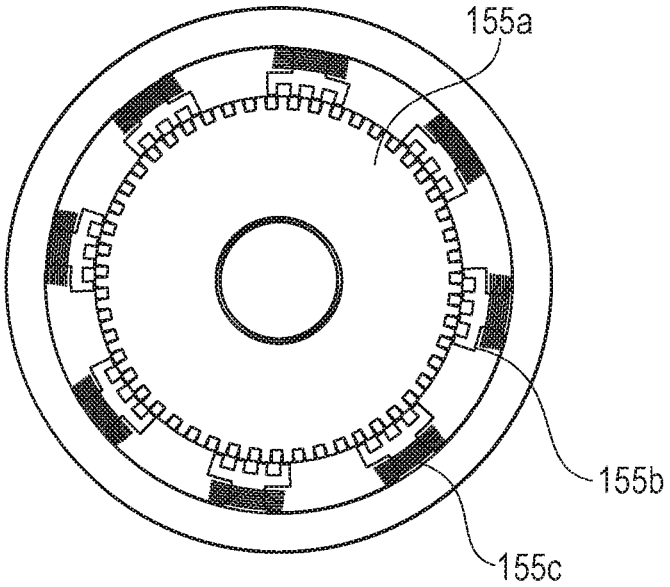
FIGS. 12A and 12B illustrate an example configuration of a stepping motor, in accordance with an embodiment of the subject disclosure.
Figure 12B:
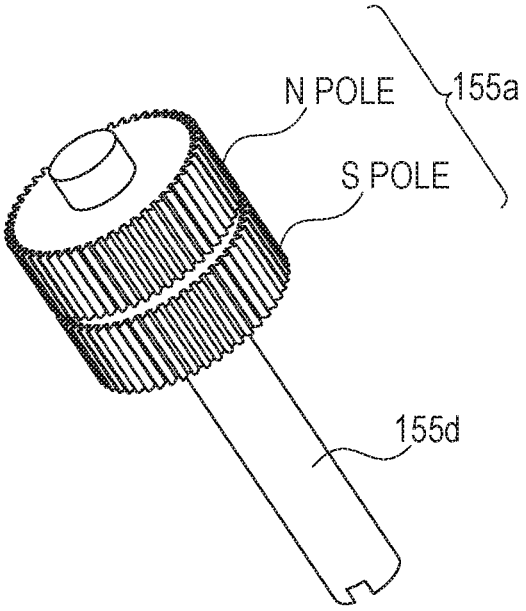

With reference to FIGS. 12A and 12B, an example stepping motor will be described.

A stepping motor 155 includes a rotor unit (rotor) 155*a* having a plurality of small teeth of a south pole and a north pole of a permanent magnet and a stator unit (magnetic field generating unit) 155*b* configured to generate a magnetic field with a coil 155*c*. The stator unit 155*b* has a plurality of small teeth. When the amount of electric current to be fed to the coil 155*c* is switched, a plurality of excitation phases can be generated. The stepping motor 155 switches the excitation phase of the stator unit 155*b* to rotate the rotor unit 155*a*. The rotor unit 155*a* has a rotation axis 155*d*, and the rotation of the rotor unit 155*a* is followed by rotation of the rotation axis 155*d*.

The rotor unit 155*a* rotates in stepwise manner by a predetermined angle every time the excitation phase of the stator unit 155*b* is switched. In other words, the total angle of rotation of the rotor unit 155*a* depends on the number of times of switching of the excitation phase. The CPU 10 inputs a pulse signal to a motor driver 180 where the pulse signal is a signal to instruct the amount of rotation of the rotor unit 155. The motor driver 180 controls the mount of electric current to be fed to the coil 155*c* based on the input pulse signal. This can switch the excitation phase of the stator unit 155*b* the number of times instructed by the pulse signal. The rotor unit 155*a* moves by a rotation angle in an expression of rotation angle (amount of rotation)=step angle×number of pulses where the step angle is a rotation angle of movement of the rotor unit 155*a* due to one switching operation of the excitation phase. In other words, the rotor unit 155*a* in the stepping motor 155 can rotate by an angle (amount of rotation) corresponding to the pulse signal.

It means that the CPU 10 functions as an output unit configured to output a signal to instruct the amount of rotation of the rotor unit 155*a*. The motor driver 180 functions as an electric current control unit configured to control the amount of electric current to be fed to the coil 155*c* based on the pulse signal. The CPU 10 and the motor driver 180 function as a motor control unit configured to control rotation of the stepping motor 155.

Having described the configuration in which a pulse signal is input to the motor driver 180 according to this embodiment, a pulse signal may be generated within the motor driver 180 for control over the amount of electric current to be fed to the coil 155*c*.

Belt Position Detecting Unit

Figure 10:
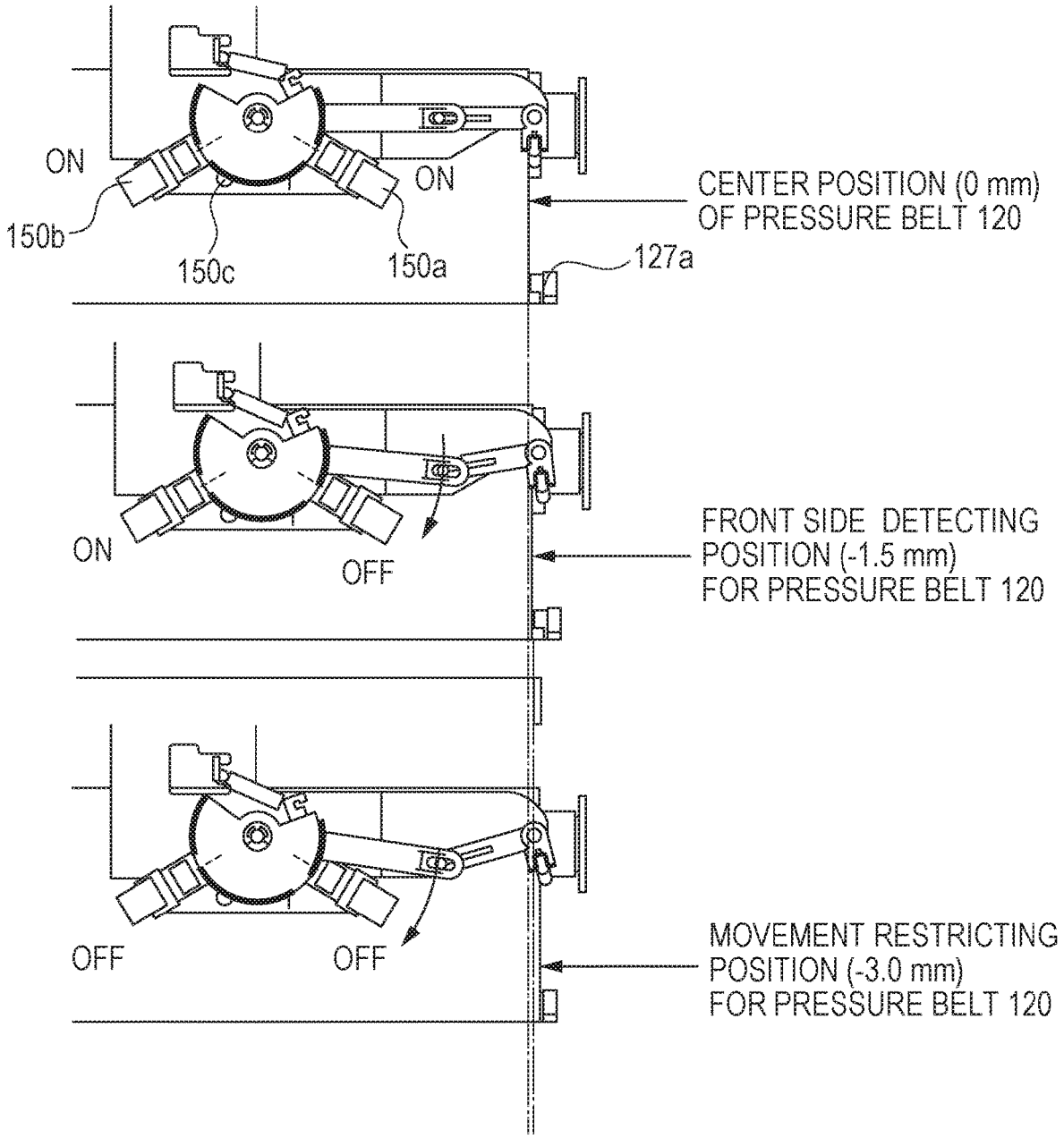
FIG. 10 illustrates a relationship between belt positions and sensor flags, in accordance with an embodiment of the subject disclosure.

The sensor unit 150 (FIG. 8) is a belt detecting unit configured to detect a belt position in a lateral direction of the pressure belt 120. The sensor unit 150 includes two belt position sensors 150*a* and 150*b*, a sensor flag 150*c* (FIG. 10), a sensor arm 150*d*, and a sensor spring 150*e*. Each of the belt position sensors 150*a* and 150*b* is a transmission optical sensor. The sensor arm 150*d* is pressed and is abutted with force of 0.03 N against an end face of the pressure belt 120 by the sensor spring 150*e*. Thus, movement of the pressure belt 120 in the lateral direction is followed by movement of the sensor arm 150*d*. The sensor flag 150*c* turns by following the movement of the sensor arm 150*d*. As illustrated in FIG. 10, the sensor flag 150*c* shields the belt position sensors 150*a* and 150*b* based on the turn position of the sensor flag 150*c*. The sensor unit 150 is configured to detect the position in the lateral direction of the pressure belt 120 based on a combination of ON/OFF signals of the belt position sensors 150*a* and 150*b*.

FIG. 9 illustrates a relationship between combinations of ON/OFF signals of the belt position sensors 150*a* and 150*b* and the corresponding positions of the pressure belt 120 according to this embodiment. The belt position sensors 150*a* and 150*b* output an OFF signal when the sensor flag 150*c* shields light and an ON signal when it allows light to pass through. It is to be understood that the relationship between combinations of ON/OFF signals output from the belt position sensors 150*a* and 150*b* and the corresponding positions of the pressure belt 120 is given for illustration purpose, and embodiments of the present disclosure are not limited thereto.

According to this embodiment, the pressure belt 120 is controlled to position within a range of ±1.5 mm from the center position in the rotation axis direction. The CPU 10 performs reciprocal movement control such that the pressure belt 120 can be placed between a position (+1.5 mm) where the belt position sensors 150*a* and 150*b* output ON and OFF signals, respectively, and a position (−1.5 mm) where the belt position sensors 150*a* and 150*b* output OFF and ON signals, respectively. In this case, the center position is defined as zero, and the front side is indicated by a negative sign while the back side is indicated by a positive sign.

FIG. 10 illustrates a relationship between belt position and sensor flag based on an example relationship between position of the pressure belt 120 and ON/OFF signals from the belt position sensors 150*a* and 150*b* in a case where the pressure belt 120 is placed between the center and the front side.

As illustrated in FIG. 10, when the pressure belt 120 is placed at the center (0 mm), all of the sensor flag 150*c* and the belt position sensors 150*a* and 150*b* have an ON state. When the pressure belt 120 moves to the front side, the sensor flag 150*c* operates clockwise in FIG. 10 through the sensor arm 150*d* abutted against the end of the pressure belt 120.

When the pressure belt 120 reaches the position at −1.5 mm on the front side, the sensor flag 150*c* shields the belt position sensor 150*a* so that the signal of the belt position sensor 150*a* is switched to an OFF state (resulting in detection of the sensor flag 150*c* by the belt position sensor 150*a*). At that time, the belt position sensor 150*b* still keeps outputting an ON signal. In response to the switching from an ON to an OFF of the signal from the belt position sensor 150*a*, the CPU 10 operates the stepping motor 155 to tilt the tension roller 122 so that the pressure belt 120 is moved toward the back side.

Here, the CPU 10 controls the steering amount of the tension roller 122 based on the detection result from the motor HP sensor 153.

More specifically, in response to detection of a fact that the pressure belt 120 is deviated toward one end side by the sensor unit 150 configured to detect the position in the lateral direction of the pressure belt 120, the CPU 10 gives a command to change the steering direction to the stepping motor 155. In other words, the CPU 10 gives a command to start rotation by designating a rotation direction (such as counterclockwise or CCW) to the stepping motor 155 for changing the steering direction. The CPU 10 causes the stepping motor 155 to keep rotating until the logic of the signal from the motor HP sensor 153 is switched.

When the stepping motor 155 rotates in the instructed direction, the logic of the signal from the motor HP sensor 153 is switched (such as from an OFF signal to an ON signal). In response to detection of the switching of the logic of the motor HP sensor 153, the CPU 10 gives a rotation command to the stepping motor 155 to rotate in the same rotation direction (such as counterclockwise or CCW) and by a predetermined number of times (such as the amount of rotation corresponding to 100 pls). Thus, a target steering angle can be acquired.

When the moving direction of the pressure belt 120 is reversed (that is, the pressure belt 120 moves toward the back side) and its position enters within a range of ±1.5 mm, the sensor flag 150*c* is positioned not to shield the belt position sensor 150*a*. In other words, the belt position sensor 150*a* outputs an ON signal. The belt position sensor 150*b* keeps outputting an ON signal.

Illustrating in FIG. 10 the relationship between position of the pressure belt 120 and ON/OFF signals from the belt position sensors 150*a* and 150*b* in a case where the pressure belt 120 is at a position from the center to the front side, the sensor unit 150 may also detect the position of the pressure belt 120 in a range from the back side to the center. When the pressure belt 120 is at the center (0 mm), all of the sensor flag 150*c* and the belt position sensors 150*a* and 150*b* have an ON state. When the pressure belt 120 moves to the back side, the sensor flag 150*c* operates counterclockwise in FIG. 10 through the sensor arm 150*d* abutted against the end of the pressure belt 120. When the pressure belt 120 reaches the position at +1.5 mm on the back side, the sensor flag 150*c* shields the belt position sensor 150*b* so that the signal of the belt position sensor 150*b* is switched to an OFF state. At that time, the belt position sensor 150*a* still keeps outputting an ON signal. In response to the switching from an ON state to an OFF state of the signal from the belt position sensor 150*b*, the CPU 10 operates the stepping motor 155 to tilt the tension roller 122 so that the pressure belt 120 is moved toward the front side.

The arm 127 has an arm wall surface 127*a* at a position of ±3.5 mm in the reciprocal movement direction of the pressure belt 120. When the pressure belt 120 excessively moves in the lateral direction, the arm wall surface 127*a* and the end face of the pressure belt 120 are brought into contact, which may possibly damage the pressure belt 120. In order to prevent this, a position at ±3.0 mm may be set as a movement restricting position. When the pressure belt 120 reaches a position at ±3.0 mm, the CPU 10 determines occurrence of a malfunction. The CPU 10 terminates the operation of the fixing device 100 until the malfunction is solved by replacement or repair of the corresponding component, for example. In other words, the CPU 10 terminates the rotations of the heating belt 130 and the pressure belt 120. The CPU 10 further terminates energization of an induction heating apparatus 300. The termination of the operation of the fixing device 100 terminates the operations of the image forming units U, inhibiting execution of image forming operations (print start).

More specifically, referring to FIG. 10, when the pressure belt 120 reaches a position at −3.0 mm being a movement restricting position on the front side, the sensor flag 150*c* shields both of the belt position sensors 150*a* and 150*b*. In other words, the belt position sensors 150*a* and 150*b* output an OFF signal. In response to the switching to the OFF signals from the belt position sensors 150*a* and 150*b*, the CPU 10 determines occurrence of a malfunction. When the pressure belt 120 reaches a position at +3.0 mm being a movement restricting position on the back side, the sensor flag 150*c* shields both of the belt position sensors 150*a* and 150*b*. In other words, the belt position sensors 150*a* and 150*b* output an OFF signal. In response to the switching to the OFF signals from the belt position sensors 150*a* and 150*b*, the CPU 10 determines occurrence of a malfunction.

Loss of Synchronization of Stepping Motor

In a case where a large load torque acts on the rotor unit 155*a* in the stepping motor 155, the movement of the S pole and N pole teeth of the rotor unit 155*a* may not follow a change in magnetic field generated by the stator unit 155*b*. As a result, synchronization between the rotor unit 155*a* and the stator unit 155*b* may be lost. The phenomenon that the synchronization between the rotor unit 155*a* and the stator unit 155*b* is lost is called a loss of synchronization. Such a loss-of-synchronization phenomenon may occur when a load applied to the stepping motor 155 changes largely or when a torque output from the stepping motor 155 changes largely. Therefore, it may occur easily when the stepping motor 155 under a large load starts rotating.

When synchronization between the rotor unit 155*a* and the stator unit 155*b* is lost, and the lost synchronization is not solved, the rotor unit 155*a* does not rotate in response to a change of magnetic field of the stator unit 155*b*. In this case, the stepping motor 155 cannot be controlled. This phenomenon is called a complete loss of synchronization herein.

When a complete loss of synchronization occurs, a steering operation cannot be performed. As a result, for example, a malfunction may occur in which the pressure belt 120 laterally deviates to a movement restricting position, which terminates operations of the image forming apparatus 1. It may possibly be inconvenient for a user that he or she cannot use the image forming apparatus 1 until replacement or repair of the corresponding component completes.

On the other hand, when a slight loss of synchronization occurs, the S pole and N pole teeth of the rotor unit 155*a* in the stepping motor 155 may get synchronization again at a position where the rotor unit 155*a* is out of phase from the stator unit 155*b* even though a loss of synchronization temporarily occurs, enabling the stepping motor 155 to rotate. This phenomenon is called a slight loss of synchronization herein. During movements of the stepping motor 155, a slight loss of synchronization may relatively easily occur when the stepping motor 155 is started to rotate after being stopped (see FIG. 14, (xv), for example, which will be described below). However, even after a slight loss of synchronization occurs upon start of rotation, recovery of synchronization may prevent an influence on rotation control (see FIG. 14, (xvi) to (xvii), for example, which will be described below) from a time when the motor flag 152*c* passes by the motor HP sensor 153 to a time when it is stopped. Therefore, the steering operation functions for tilting the tension roller 122 to a target angle.

When a slight loss of synchronization, it may be inferred that a load larger than a normal state but smaller than that with a complete loss of synchronization may be applied to the stepping motor 155. When a further larger load is applied to the stepping motor 155, a complete loss of synchronization may possibly occur. In other words, a state having a slight loss of synchronization may be interpreted as a sign of a complete loss of synchronization.

Accordingly, in the image forming apparatus 1 of this embodiment, when a slight loss of synchronization occurs, occurrence of an error is notified to a user. In this case, because the slight loss of synchronization may merely temporarily cause a loss of synchronization between the rotor unit 155*a* and the stator unit 155*b* in the stepping motor 155, the stepping motor 155 can continue its steering operation. The image forming apparatus 1 continues its image forming operation unless another malfunction occurs (such as laterally deviation of the pressure belt 120 to a movement restricting position). In other words, the fixing device 100 does not stop operating.

This may enable a user to recognize the occurrence of the malfunction in the fixing device 100 before the fixing device 100 stops operating. A user may replace or repair the corresponding component at a time convenient to him or her such as after a printing operation in progress completes, improving the convenience of the user.

Method for Detecting Slight Loss of Synchronization

Next, a method for detecting a slight loss of synchronization will be described.

Figure 14:
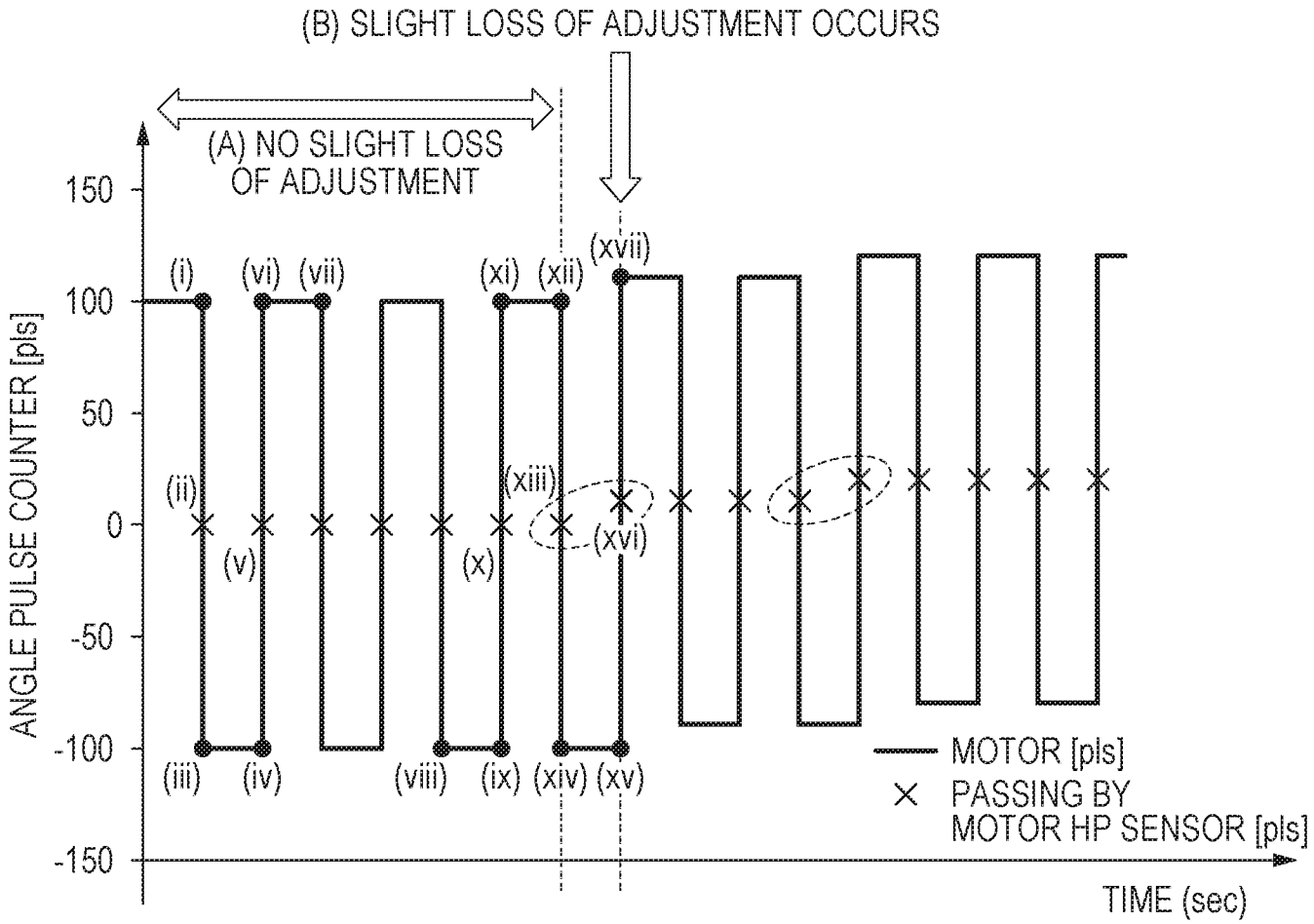
FIG. 14 illustrates changes of angle pulses with slight losses of synchronization of a stepping motor, in accordance with an embodiment of the subject disclosure.

FIG. 14 illustrates changes of angle pulses following a slight loss of synchronization in a stepping motor.

Here, a term "angle pulse" refers to a number of pulses designated by the CPU 10. The angle pulse corresponds to a rotation angle (amount of rotation) of the rotor unit 155*a* instructed by the CPU 10. The illustrated counter is configured to count based on assumptions that the direction of rotation to be instructed by the CPU 10 is positive or negative and that the number of pulses is an absolute value. More specifically, in a case where the CPU 10 outputs an instruction signal to rotate the stepping motor for 100 pulses in a first direction (such as a CW direction), 100 is added to the value of the counter. In a case where the CPU 10 outputs an instruction signal to rotate the stepping motor for 100 pulses in a second direction (for example, CCW direction) being an opposite direction of the first direction, 100 is subtracted from the value of the counter.

FIG. 14 illustrates a vertical axis indicating a count value of angle pulses commanded by the CPU 10. It is assumed here that the angle pulse value is equal to 0 at a normal home position. A sign "x" in FIG. 14 indicates a position where the rotation of the stepping motor 155 causes the motor flag 152*c* to pass by the motor HP sensor 153 (when the ON/OFF state of the motor HP sensor 153 is switched). FIG. 14 further illustrates a horizontal axis indicating a passage of time. More accurately, periods from (i) to (iii) and from (iv) to (vi) in FIG. 14 also have passages of time, and times (i) and (iii) and times (iv) and (vi) are not equal clock times, though they are schematically Illustrated in FIG. 14.

Referring to FIG. 14, a region indicated by an arrow (A) has a normal state without a slight loss of synchronization. At (i), when the sensor unit 150 detects that the pressure belt 120 is placed at an angle changing position (such as −1.5 mm), the stepping motor 155 is rotated in a CCW (counterclockwise) direction. The CPU 10 causes the stepping motor 155 to keep rotating until it passes by the motor HP sensor 153 (during a period from (i) to (ii) in FIG. 14). In response to detection of that the motor flag 152*c* passes by the motor HP sensor 153 at (ii) due to the rotation of the stepping motor 155, the CPU 10 transmits a signal to the stepping motor 155 to rotate for 100 pulses in the CCW direction and then stop. The stepping motor 155 changes its excitation phase a number of times corresponding to the 100 pulses and stops the rotor unit 155*a* at (iii) (during a period from (ii) to (iii) in FIG. 14). If the sensor unit 150 detects that the pressure belt 120 is placed at an angle changing position (such as +1.5 mm) at (iv), the CPU 10 causes the stepping motor 155 to rotate in the CW (clockwise) direction. The CPU 10 causes the stepping motor 155 to keep rotating until it passes by the motor HP sensor 153 (during a period from (iv) to (v) in FIG. 14). In response to detection of that the motor flag 152*c* passes by the motor HP sensor 153 at (v) due to the rotation of the stepping motor 155, the CPU 10 transmits a signal to the stepping motor 155 to rotate for 100 pulses in the CW direction and then stop. The stepping motor 155 changes its excitation phase a number of times corresponding to the 100 pulses and stops the rotor unit 155*a* at (vi) (during a period from (v) to (vi) in FIG. 14). This cycle is repeated during the steering operation.

On the other hand, in a case where a slight loss of synchronization occurs, the value of the angle pulse counter when the motor flag 152*c* passes by the motor HP sensor 153 deviates from the value (zero) in the region indicated by the arrow (A). This state is indicated by an arrow (B) in FIG. 14.

In response to detection of that the motor flag 152*c* passes by the motor HP sensor 153 at (xiii) due to the rotation of the stepping motor 155, the CPU 10 transmits a signal to the stepping motor 155 to rotate for 100 pulses in the CCW direction and then stop. The stepping motor 155 changes the excitation phase a number of times corresponding to the 100 pulses and stops the rotor unit 155*a* (at (xiv) in FIG. 14). If the sensor unit 150 detects that the pressure belt 120 is placed at an angle changing position (such as +1.5 mm) at (xv), the CPU 10 causes the stepping motor 155 to rotate in the CW (clockwise) direction. The CPU 10 causes the stepping motor 155 to keep rotating until it passes by the motor HP sensor 153. In response to detection of that the motor flag 152*c* passes by the motor HP sensor 153 at (xvi) due to the rotation of the stepping motor 155, the CPU 10 transmits a signal to the stepping motor 155 to rotate for 100 pulses in the CW direction and then stop.

When a slight loss of synchronization occurs, the number of times of changing of the excitation phase increases until the stepping motor 155 passes by the motor HP sensor 153 (during a period from (xv) to (xvi) in FIG. 14) though the stepping motor 155 rotates. In other words, at (xvi), the value of the angle pulse counter is not equal to 0 (such as 10) when the stepping motor 155 passes by the motor HP sensor 153. The image forming apparatus 1 according to this embodiment detects it as occurrence of a slight loss of synchronization and provides an error notification.

The image forming apparatus 1 includes a counter (counting unit) configured to count angle pulses (amount of rotations, the number of pulses, or the number of times of changing of the excitation phase) that the CPU 10 instructs the stepping motor 155. In order to change the direction of tilting of the tension roller 122, the counter is configured to count the angle pulses instructed to the stepping motor 155 until the stepping motor 155 passes by the motor HP sensor 153 (during during a period from (xv) to (xvi) in FIG. 14, for example). The CPU 10 determines occurrence of a slight loss of synchronization if the amount of change of the value of the counter exceeds a predetermined value.

According to this embodiment, the image forming apparatus 1 includes a counter C configured to count the number of times of changing of the excitation phase corresponding to the angle pulses instructed to the stepping motor 155, as indicated by the vertical axis in FIG. 14. A part of the storage region of a RAM (storage unit) 600 functions as the counter C. When the stepping motor 155 is rotated in the CW direction (during a period from (iv) to (vi) in FIG. 14, for example) where a value X of the counter C at the home position is equal to 0, the CPU 10 counts up the value of the counter C. When the stepping motor 155 is rotated in the CCW direction (during a period from (i) to (iii) in FIG. 14, for example), the CPU 10 counts down the value of the counter C. The CPU 10 compares the value of the counter C when the stepping motor 155 passes by the motor HP sensor 153 with the value in the last steering operation. In accordance with whether the amount of change exceeds a predetermined value or not, whether a slight loss of synchronization is occurring or not is determined.

In a case where the signal from the motor HP sensor 153 does not change even after a lapse of a predetermined time period from transmission of a rotation command to the stepping motor 155, the CPU 10 determines that the stepping motor 155 is not rotating (or determines that a complete loss of synchronization has occurred). Stepping Motor Control With reference to flowcharts in FIGS. 1 to 3, control over the stepping motor according to this embodiment will be described.

Figure 13:
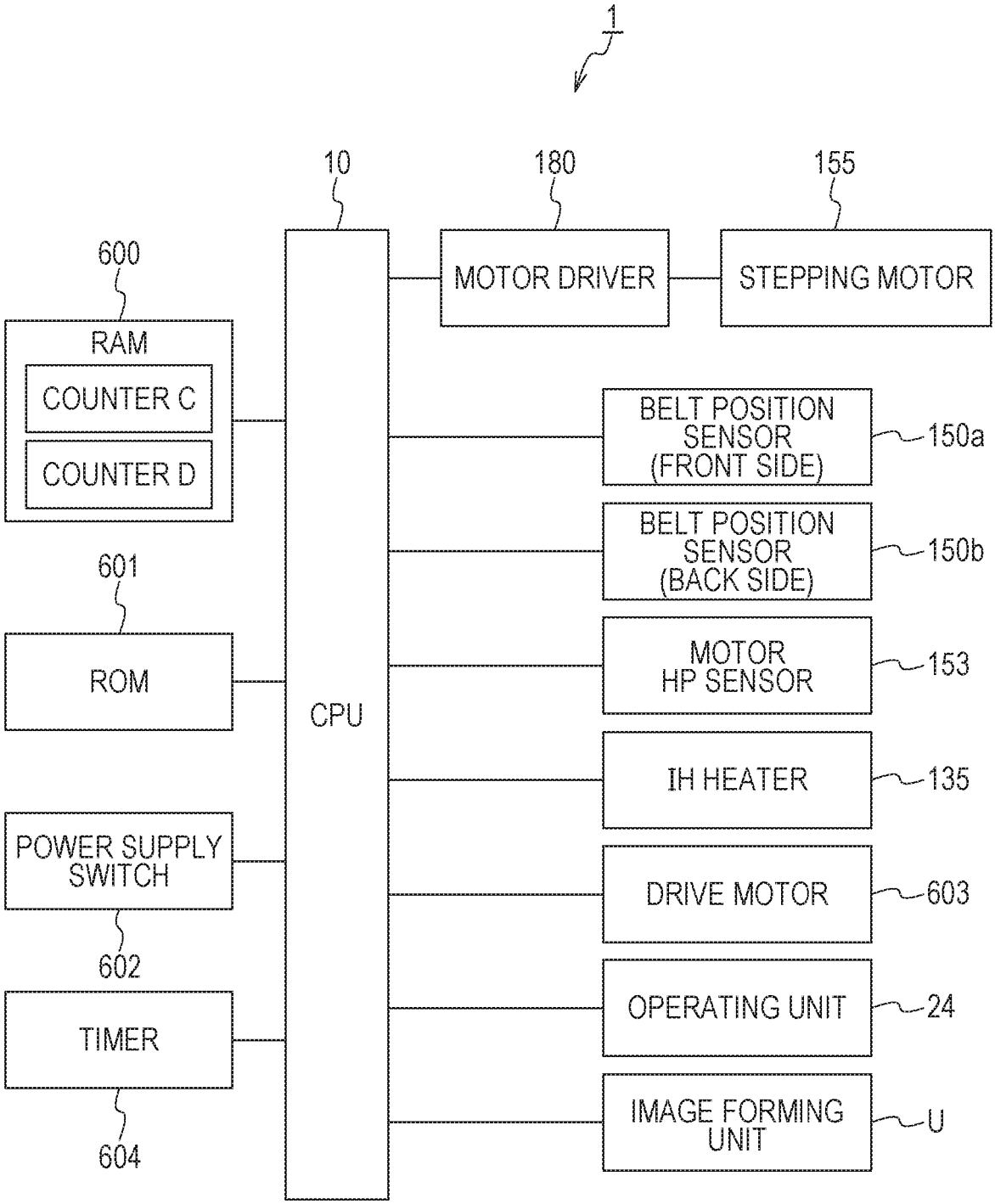
FIG. 13 is a block diagram relating to control, in accordance with an embodiment of the subject disclosure.

FIG. 13 is a block diagram illustrating a configuration relating to the control. The CPU 10 is electrically connected to a ROM (read-only memory) 601 and the RAM (random-access memory) 600. Operations illustrated in the flowcharts are executed by the CPU 10 functioning as a control unit based on a control program stored in the ROM 601. The CPU 10 uses the RAM 600 as a work area for executing processes in the control program.

As illustrated in FIG. 13, the CPU 10 is electrically connected to the RAM 600, the ROM 601, and mechanisms to be controlled. More specifically, the CPU 10 is electrically connected to the belt position sensors 150*a* and 150*b*, the motor HP sensor 153, the IH heater 135, a drive motor 603, an image forming unit U, an operating unit 24, and a power supply switch 602. The CPU 10 is electrically connected to the stepping motor 155 through the motor driver 180 and functions as a motor control unit configured to control driving of the stepping motor 155. The CPU 10 further functions as a rotation control unit configured to control the drive motor 603.

A timer 604 will be described with reference to a configuration according to a fifth embodiment.

According to this embodiment, one CPU 10 has a plurality of functions (such as functioning as a motor control unit and a rotation control unit) to control the mechanisms in the image forming apparatus 1. However, a CPU or a control circuit may be provided for each of the plurality of functions.

Figure 1:
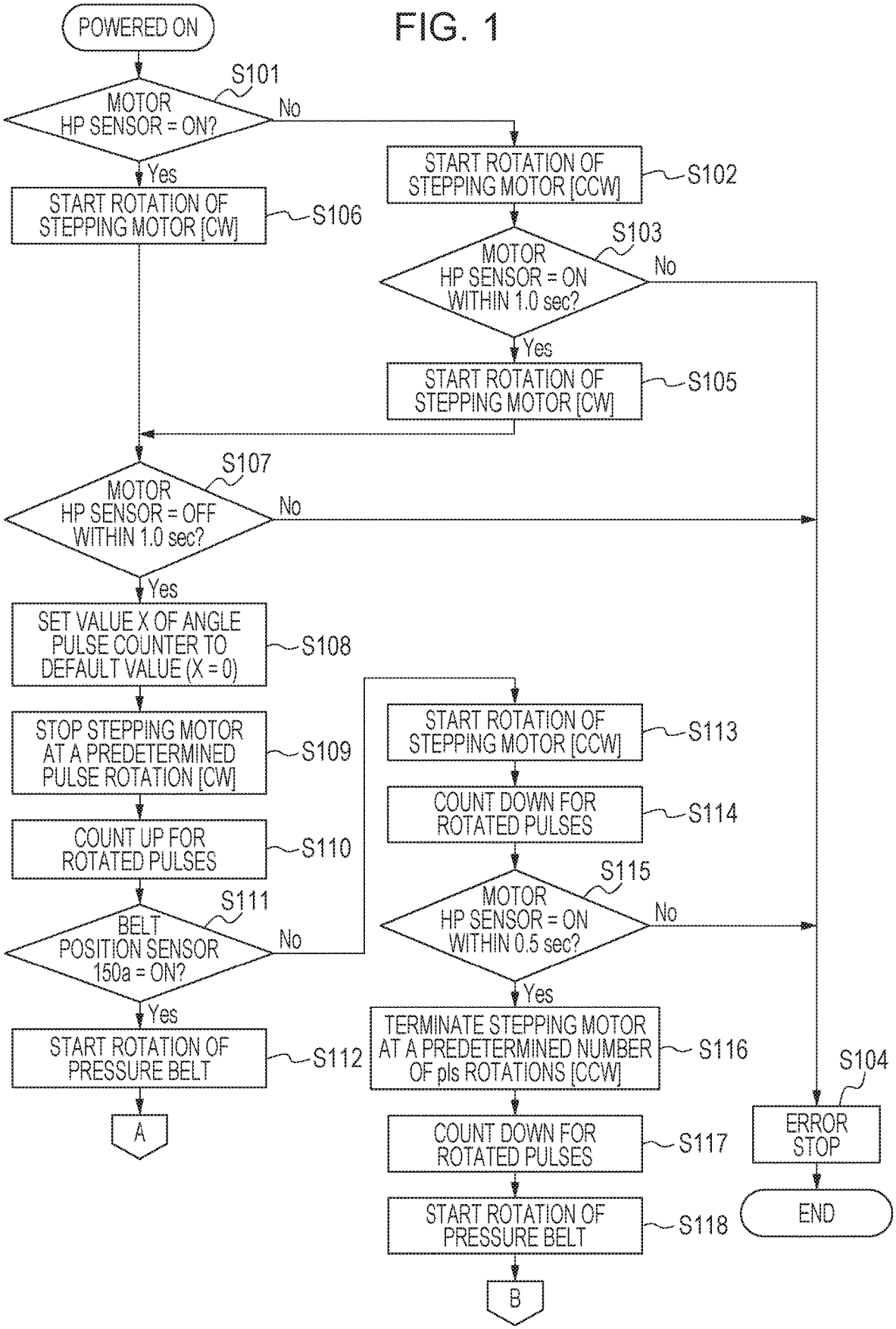
FIG. 1 is a flowchart illustrating a control over a stepping motor, in accordance with an embodiment of the subject disclosure.

FIG. 1 is a flowchart illustrating processing from a time when the power supply switch 602 is turned on to a time when the pressure belt 120 starts rotating. The flowchart in FIG. 1 is continued to the flowchart in FIG. 2.

According to this embodiment, a control flow to be performed in the image forming apparatus 1 having the following settings will be described as an example.

More specifically, the pressure belt 120 starts rotating with the stepping motor 155 rotated in the CW direction for a predetermined angle pulses, except for a case where the pressure belt 120 is already at the angle changing position (−1.5 mm) on the front side when the power supply switch 602 is turned on. In other words, after the pressure belt 120 is rotated, the pressure belt 120 starts to laterally deviate toward the front side.

In a case where the stepping motor 155 is rotated in the CW direction, the motor HP sensor 153 changes its output signal from an ON signal to an OFF signal at an instance when the motor flag 152*c* passes by the motor HP sensor 153. Conversely, in a case where the stepping motor 155 is rotated in the CCW direction, the motor HP sensor 153 changes its output signal from an OFF signal to an ON signal at an instance when the motor flag 152*c* passes by the motor HP sensor 153.

FIG. 9 illustrates combinations of positions in the lateral direction of the pressure belt 120 and detection results provided by the sensor unit 150.

The CPU 10 checks whether the pressure belt 120 is placed at a movement restricting position (±3.0 mm) or not while executing the following processing illustrated in the flowcharts. That is, the CPU 10 monitors outputs from the belt position sensors 150*a* and 150*b*. In response to detection of that both of the belt position sensors 150*a* and 150*b* have an OFF state, the CPU 10 interrupts the following processing and error stops the fixing device 100.

Referring to FIG. 1, processing in S101 to S107 checks operations performed by mechanisms relating to steering operations.

When an operator turns on the power supply switch 602 in the image forming apparatus 1, the CPU 10 obtains an ON/OFF state of the motor HP sensor 153 and determines whether the motor HP sensor 153 has an ON state or an OFF state (S101).

If the CPU 10 determines that the motor HP sensor 153 has an ON state (S101, Yes), the CPU 10 causes the stepping motor 155 to rotate in a direction (CW direction according to this embodiment) for changing a reaction of the motor HP sensor 153 (S106). In other words, the CPU (output unit) 10 transmits a command signal to rotate the stepping motor 155 in the CW direction to the motor driver 180. This means that the CPU 10 functions as an output unit configured to output a signal for instructing an amount of rotation of the rotor unit 155*a* and a signal for instructing the direction of rotation of the rotor unit 155*a*. The motor driver (electric current control unit) 180 controls the amount of electric current to be fed to the coil 155*c* to rotate the stepping motor 155 in the CW direction so that the excitation phase is changed.

The CPU 10 keeps the stepping motor 155 to rotate in the CW direction and determines whether the motor HP sensor 153 reacts within a predetermined time period (such as within 1.0 sec) or not (S107). Thus, whether a mechanism relating to a steering operation has a malfunction or not is checked.

If the reaction of the motor HP sensor 153 is not changed to an OFF state within the predetermined time period even though the stepping motor 155 is kept rotating in the CW direction (S107, No), the CPU 10 determines that a mechanism relating to a steering operation has a malfunction and performs the error stop (S104). In other words, the CPU 10 functions as an inhibiting unit configured to inhibit operations to be performed by the image forming apparatus 1. The image forming apparatus 1 disables the fixing device 100 to operate unless the malfunction is solved.

On the other hand, if the motor HP sensor 153 has an OFF state in S101 (S101, No), the CPU 10 causes the stepping motor 155 to rotate in a direction with which the motor HP sensor 153 changes its reaction, that is, in the CCW direction (S102).

The CPU 10 causes the stepping motor 155 to keep rotating in the CCW direction and determines whether the motor HP sensor 153 reacts within a predetermined period (such as within 1.0 sec) or not (S103). Thus, whether a mechanism relating to a steering operation has a malfunction or not can be checked.

If the motor HP sensor 153 does not output an ON signal within a predetermined period even the stepping motor 155 is kept rotating in the CCW direction (S103, No), the CPU 10 determines that a mechanism relating to a steering operation has a malfunction and performs an error stop (S104).

If the motor HP sensor 153 is changed to output an ON signal within the predetermined period as a result of the continuous rotation of the stepping motor 155 in the CCW direction caused by the CPU 10 (S103, Yes), the processing moves to S105. According to this embodiment, the stepping motor 155 is rotated for predetermined angle pulses in the CW direction, and the rotation of the pressure belt 120 is then started. Therefore, the CPU 10 causes the stepping motor 155 to rotate in the CW direction (S105). If the reaction of the motor HP sensor 153 is not changed to an OFF state within the predetermined period even though the stepping motor 155 is kept rotating in the CW direction (S107, No), the CPU 10 determines a mechanism relating to a steering operation has a malfunction and executes an error stop (S104).

The operation check to be performed on mechanisms relating to steering operations has been described up to this point.

Next, in S108 to S117, the position of the stepping motor 155 is adjusted, and the pressure belt 120 starts rotating.

Because the angle pulse at an instance when the reaction of the motor HP sensor 153 is changed to an OFF state in S107 is referred, the CPU 10 sets, as an initial value, a value X of the counter C configured to count angle pulses (S108). More specifically, a relationship X=0 is set.

In response to the change of the reaction of the motor HP sensor 153 to OFF in S107, the CPU 10 transmits a command to the stepping motor 155. More specifically, the CPU 10 transmits a command signal to rotate the stepping motor 155 for predetermined angle pulses (such as 100 pulses) in the CW direction and stops the stepping motor 155 with predetermined angle pulses (S109).

The CPU 10 uses the counter C to count up the value corresponding to the angle pulses rotated in S109 (S110).

Here, the CPU 10 determines whether the pressure belt 120 is present at a front side angle changing position (−1.5 mm) or not based on an output from the sensor unit 150 (Sill). More specifically, whether the belt position sensor 150*a* has an ON state or not is determined.

If the belt position sensor 150*a* has an ON state (S111, Yes), the pressure belt 120 is not at the front side angle changing position (−1.5 mm). Therefore, the CPU 10 controls the drive motor 603 to cause the pressure belt 120 to start rotating (S112). The CPU 10 advances the processing to S201 in FIG. 2.

If the belt position sensor 150*a* has an OFF state on the other hand (S111, No), the pressure belt 120 is at the front side angle changing position (−1.5 mm). Therefore, the CPU 10 causes the stepping motor 155 to rotate in the CCW direction (S113). If the pressure belt 120 at the front side angle changing position (−1.5 mm) is rotated after the stepping motor 155 is rotated in the CW direction, the rotation may possibly be followed by movement of the pressure belt 120 to a front side movement restricting position (−3.0 mm).

The CPU 10 transmits a command to the motor driver 180 every pulse until the motor HP sensor 153 is changed to have an ON state and causes the stepping motor 155 to rotate in the CCW direction. The CPU 10 uses the counter C to count down the value corresponding to the rotated angle pulses (S114).

If the motor HP sensor 153 does not react (or keeps its OFF state) within a predetermined period (such as within 0.5 sec) from the start of rotation in S113 (S115, No), the CPU 10 advances the processing to S104. The CPU 10 determines that a mechanism relating to a steering operation has a malfunction and executes an error stop (S104).

The CPU 10 transmits a command to the stepping motor 155 in response to the change of the motor HP sensor 153 to an ON state in S115. More specifically, the CPU 10 transmits to the stepping motor 155 a command to rotate for predetermined angle pulses (such as 100 pulses) in the CCW direction and stops the stepping motor 155 at the predetermined angle pulses (S116). After that, the CPU 10 causes the pressure belt 120 to start rotating (S118). Here, the CPU 10 uses the counter C to count down the value corresponding to the angle pulses rotated in S116 (S117). After S118, the CPU 10 advances the processing to S210 in FIG. 2.

FIG. 2 is a flowchart illustrating steering operations to be performed from a time when the pressure belt 120 starts rotating to execution of an error stop. Referring to the flowchart in FIG. 2, the pressure belt 120 keeps rotating except that the fixing device 100 undergoes an error stop. The image forming apparatus 1 performs steering operations while the pressure belt 120 is being rotated for reciprocal movement control over the pressure belt 120.

In the middle of the flowchart in FIG. 2, if the CPU 10 receives an image formation instruction (such as a print start instruction or a copy start instruction), the CPU 10 executes the received image formation instruction. Also while the image forming operation corresponding to the image formation instruction and a fixing process are being executed, the steering operation is continued in the fixing device 100, as illustrated in FIG. 2.

In the middle of the flowchart in FIG. 2, when the power supply switch 602 is turned off, the CPU 10 interrupts the processing in the flowchart in FIG. 2 to stop the rotation of the pressure belt 120.

The pressure belt 120 started to rotate in S112 in FIG. 1 starts laterally deviating toward the front side while rotating. If the belt position sensor 150*a* is changed to have an OFF state (S201, Yes), the CPU 10 advances the processing to S202. When the belt position sensor 150*a* is changed to have an OFF state, the pressure belt 120 is placed at the front side angle changing position (−1.5 mm).

In order to move the pressure belt 120 to the back side, the CPU 10 causes the stepping motor 155 to rotate in the CCW direction (S202). The CPU 10 transmits a command to the motor driver 180 every pulse until the motor HP sensor 153 is changed to have an ON state and causes the stepping motor 155 to rotate in the CCW direction. The CPU 10 uses the counter C to count down the value corresponding to the rotated angle pulses (S203). The period from (i) to (ii) in FIG. 14 corresponds to exemplary states of counting by the counter C in S203.

If the motor HP sensor 153 does not react (or keeps its OFF state) within a predetermined period (such as within 0.5 sec) from the start of rotation in S202 (S204, No), the CPU 10 advances the processing to S205. The CPU (inhibiting unit) 10 determines that a mechanism relating to a steering operation has a malfunction and executes an error stop (S205). For the error stop, the image forming apparatus 1 inhibits the fixing device 100 from operating unless the malfunction is solved. More specifically, the CPU 10 controls the drive motor 603 in S205, stops the rotation of the pressing roller 121 and stops the energization to the IH heater 135, unless the malfunction is solved. The CPU 10 further inhibits execution of an image forming operation to be performed by the image forming units U unless the malfunction is solved.

In response to the switching of the motor HP sensor 153 to an ON state in S204, the CPU 10 stores the value X of the counter C at an instance when the motor HP sensor 153 is switched to an ON state in S204 to a predetermined region on the RAM 600 (S206). A sequence for determining a slight loss of synchronization (S207) is then performed. The sequence for determining a slight loss of synchronization will be described below.

The CPU 10 transmits a command to the stepping motor 155 with reference to an instance when the motor HP sensor 153 is switched to an ON state in S204. More specifically, the CPU 10 transmits to the stepping motor 155 a command to rotate for predetermined angle pulses (such as 100 pulses) in the CCW direction and a command to stop after the stepping motor 155 rotates for the predetermined angle pulses (S208). The CPU 10 uses the counter C to count down the value corresponding to the angle pulses rotated in S208 (S209). The period from (ii) to (iii) in FIG. 14 corresponds to exemplary states of counting by the counter C in S209.

The steering operations performed in S202 to S208 tilts the tension roller 122 for moving the pressure belt 120 to the back side. Thus, the pressure belt 120 laterally deviates to the back side while rotating.

After the pressure belt 120 rotates for a while after S209 or after S118 (FIG. 1), the pressure belt 120 is placed at a back side angle changing position (+1.5 mm). The belt position sensor 150*b* is switched from an ON state to an OFF state. When the belt position sensor 150*b* is changed to have an OFF state (S210, Yes), the CPU 10 advances the processing to S211.

Because the pressure belt 120 is moved toward the front side, the CPU 10 causes the stepping motor 155 to rotate in the CW direction (S211). The CPU 10 transmits a command to the motor driver 180 every pulse until the motor HP sensor 153 is changed to have an OFF state and causes the stepping motor 155 to rotate in the CW direction. The CPU 10 uses the counter C to count up the value corresponding to the rotated angle pulses (S212). The period from (iv) to (v) in FIG. 14 corresponds to an exemplary state of counting by the counter C in S211.

If the motor HP sensor 153 does not react (or keeps its ON state) within a predetermined period (such as within 0.5 sec) from the start of rotation in S211 (S213, No), the CPU 10 advances the processing to S205. The CPU 10 determines that a mechanism relating to a steering operation has a malfunction and executes an error stop (S205).

In response to the switching of the motor HP sensor 153 to an OFF state in S213, the CPU 10 stores the value X of the counter C at an instance when the motor HP sensor 153 is switched to an OFF state in S213 to a predetermined region on the RAM 600 (S214). The CPU 10 then performs a sequence for determining a slight loss of synchronization (S215). The sequence for determining a slight loss of synchronization will be described below.

The CPU 10 transmits a command to the stepping motor 155 with reference to an instance when the motor HP sensor 153 is switched to an OFF state in S213. More specifically, the CPU 10 transmits to the stepping motor 155 a command to rotate for predetermined angle pulses (such as 100 pulses) in the CW direction and a command to stop after the stepping motor 155 rotates for the predetermined angle pulses (S216). The CPU 10 uses the counter C to count up the value corresponding to the angle pulses rotated in S216 (S217). The period from (v) to (vi) in FIG. 14 corresponds to an exemplary state of counting by the counter C in S217.

The steering operations performed in S211 to S216 tilt the tension roller 122 for moving the pressure belt 120 to the front side. Thus, the pressure belt 120 laterally deviates to the front side while rotating.

After S217, the CPU 10 returns to S201 and repeats the processing flow in S201 to S217. Thus, reciprocal movement control is performed on the pressure belt 120.

Figure 3:
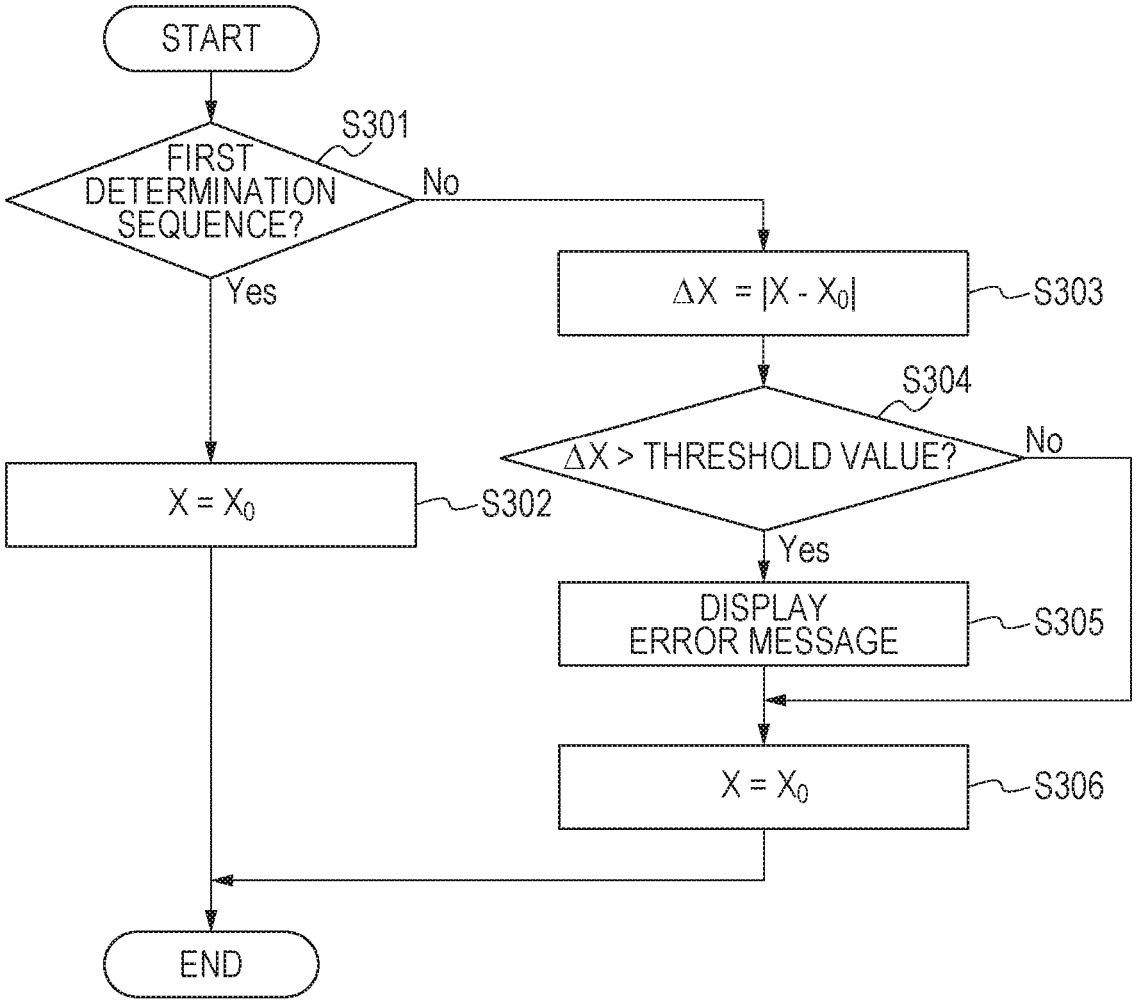
FIG. 3 is a flowchart illustrating determination of a slight loss of synchronization, in accordance with an embodiment of the subject disclosure.

Next, with reference to FIG. 3, a sequence for determining a slight loss of synchronization in S207 and S215 (as illustrated in FIG. 2) will be described. FIG. 3 is a flowchart illustrating determination of a slight loss of synchronization according to this embodiment. The CPU 10 determines a slight loss of synchronization based on whether the amount of change in value X of the counter C when the motor flag 152*c* passes by the motor HP sensor 153 exceeds a threshold value or not, according to this embodiment. More specifically, the following processing is to be performed.

The CPU 10 after the power supply switch 602 is turned on determines whether the determination sequence illustrated in FIG. 3 is performed for the first time or not (S301).

If the determination sequence illustrated in FIG. 3 is performed for the first time (S301, Yes), the CPU 10 sets the value X of the counter C stored immediately before the determination sequence (S206 or S214) to $X_0$ and stores it in the RAM 600 (S302). If the determination sequence illustrated in FIG. 3 is performed for the first time, the CPU 10 ends the determination sequence.

If the determination sequence illustrated in FIG. 3 is not performed for the first time (S301, No), the CPU 10 calculates an amount of change ΔX of the value X of the counter C when the motor flag 152*c* passes by the motor HP sensor 153. This embodiment assumes that $\Delta X=|X-X_0|$.

The CPU 10 in S303 determines whether the calculated amount of change ΔX exceeds a threshold value or not (S304). The threshold value is a preset value and is stored in the RAM 600. For example, according to this embodiment, if ΔX>6 (pulses), the CPU 10 determines that the amount of change ΔX exceeds the threshold value.

If the amount of change ΔX exceeds the threshold value (S304, Yes), the CPU (notifying unit) 10 determines that a slight loss of synchronization has occurred and notifies the occurrence of an error (S305).

In other words, the CPU 10 notifies occurrence of an error (predetermined notification) based on an output from the motor HP sensor 153 and the amount of change ΔX of the counter C configured to count the amount of rotation of the rotor unit 155*a* instructed by the CPU 10.

More specifically, the CPU (display control unit) 10 displays a message informing that an error has occurred to a display device (display unit) in the operating unit 24. The contents to be displayed here may be preset. For example, a message such as "A malfunction has occurred in the fixing device" or "Contact service man" may be displayed. Preferably, a message informing the type of an occurring error may be displayed such as "A slight loss of synchronization is occurring" or "An error relating to the steering operation is occurring." From this, an operator can be informed of that a malfunction has occurred in the fixing device 100. The notification method is not limited to display on a display device, but an error may be notified by audio, for example.

Here, even if a slight loss of synchronization has occurred (S304, Yes), the CPU 10 does not stop the operation of the image forming apparatus 1. In other words, the rotation of the pressure belt 120 is not stopped in the fixing device 100. In other words, the CPU 10 functioning as a motor control unit controls the drive motor 603 to keep the pressure belt 120 rotating. In a case where an image forming operation is being performed, image forming operations being performed by the image forming units U and a fixing operation being performed by the fixing device 100 are continued. In a standby state waiting for input of an image formation instruction, execution of an input image formation instruction is not inhibited. However, as an exception, in a case where a malfunction excluding a slight loss of synchronization and involving an error stop occurs simultaneously with occurrence of a slight loss of synchronization, the operation of the image forming apparatus 1 may be inhibited.

The CPU 10 stores the value X of the counter C stored immediately before the determination sequence (or in S206 or S214) as a new $X_0$ in the RAM 600 (S306) and ends the determination sequence.

In S304, if the amount of change ΔX does not exceed the threshold value (S304, No), the CPU 10 advances the processing to S306.

Second Embodiment

According to the first embodiment, a slight loss of synchronization is determined based on an amount of change between the value X of the counter C when the motor flag 152*c* passes by the motor HP sensor 153 and the value $X_0$ of the counter C when the motor flag 152*c* passes by the motor HP sensor 153 last time. More specifically, the determination sequence illustrated in FIG. 3 compares the values X at (xiii) and (xvi) in FIG. 14.

However, the value X of the counter C when the motor flag 152*c* passes by the motor HP sensor 153 may be compared with an initial value. In other words, if the amount of change from the initial value X of the counter C exceeds the threshold value, it is determined that a slight loss of synchronization has occurred. For example, referring to FIG. 14, the value (X=0) at (ii) and the value (X=10) at (xvi) are compared.

Figure 15:
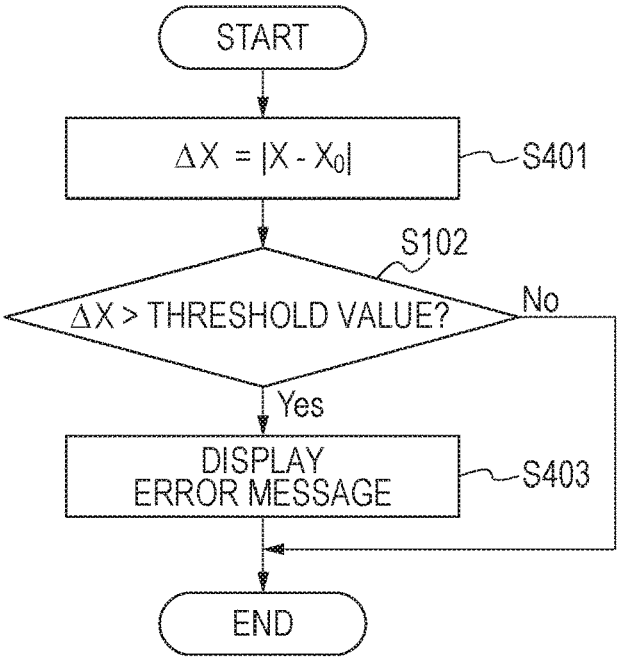
FIG. 15 is a flowchart relating to determination of a slight loss of synchronization, in accordance with an embodiment of the subject disclosure.
Figure 16:
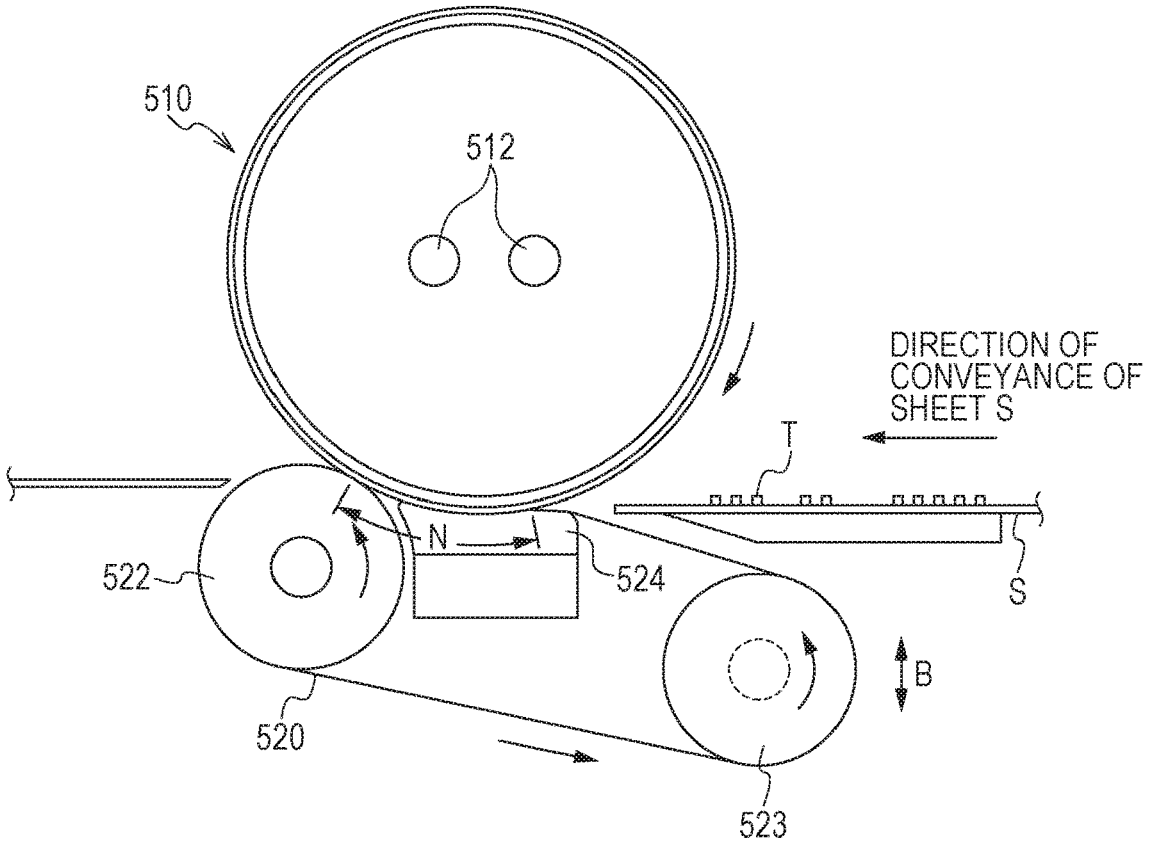
FIG. 16 illustrates an example fixing device, in accordance with an embodiment of the subject disclosure.

With reference to FIGS. 1 and 2 also according to the first embodiment and FIG. 15, a second embodiment will be described. The CPU 10 stores an initial value $X=X_0$ of the counter C set in S108 in FIG. 1 in the RAM 600. According to this embodiment, the CPU 10 performs processing illustrated in FIG. 15 as the determination sequence in S207 and S215 in FIG. 2.

The CPU 10 calculates the amount of change ΔX of the value X of the counter C when the motor flag 152*c* passes by the motor HP sensor 153 (S401). This embodiment assumes that $\Delta X=|X-X_0|$. Here, $X_0$ is an initial value of the counter C set in S108 in FIG. 1.

The CPU 10 determines whether the amount of change ΔX calculated in S401 exceeds a threshold value or not (S402). The threshold value is a preset value and is stored in the RAM 600. For example, according to this embodiment, if ΔX>50 (pulses), the CPU 10 determines that the amount of change ΔX exceeds the threshold value.

If the amount of change ΔX exceeds the threshold value (S402, Yes), the CPU 10 determines that a slight loss of synchronization has occurred, notifies the occurrence of the error (S403), and ends the determination sequence. Because details of the processing in S403 are the same as those of the processing in S305 (FIG. 3), any repetitive description will be omitted. Like S305 (FIG. 3), the CPU 10 does not stop the operation being performed by the image forming apparatus 1. In other words, the rotation of the pressure belt 120 is not stopped in the fixing device 100.

If the amount of change ΔX is not higher than the threshold value in S402 (S402, No), the CPU 10 ends the determination sequence.

Because the rest of the configuration is the same as that of the first embodiment, any repetitive description will be omitted.

Having described that, according to this embodiment, the initial value of the counter C set in S108 in FIG. 1 is equal to $X_0$, a process for causing the stepping motor 155 to operate before the pressure belt 120 starts rotating may be performed so that an average value of a plurality of operations can be determined as $X_0$. For example, processing for determining $X_0$ may be performed between S107 and S108 in FIG. 1.

More specifically, the following operations (I) to (IV) are repeated.

(I) After the motor HP sensor 153 is changed to have an OFF state, the stepping motor 155 is rotated for 100 pulses in the CW direction and is then stopped.

(II) The stepping motor 155 is rotated in the CCW direction until the motor HP sensor 153 is changed to have an ON state, and the value X of the counter C when the motor HP sensor 153 is changed to have an ON state is obtained.

(III) The stepping motor 155 is rotated for 100 pulses in the CCW direction after the motor HP sensor 153 is changed to have an ON state and is then stopped.

(IV) The stepping motor 155 is rotated in the CW direction until motor HP sensor 153 is changed to have an ON state, and the value X of the counter C when the motor HP sensor 153 is changed to have an OFF state is obtained.

For example, in a case where an average value of four rotating operations is $X_0$ irrespective of the direction of rotation of the stepping motor 155, the CPU 10 may repeat the operations (I) to (IV) twice to obtain four values X. The CPU 10 may determine the average value of the obtained four values X as $X_0$ and store it in the RAM 600. In the determination sequence, the CPU 10 compares the $X_0$ with the value $X_0$ determined in the process to determine a slight loss of synchronization.

The configuration of this embodiment can also provide similar effects to those of the first embodiment.

Third Embodiment

According to the first embodiment, the counter C counts as indicated by the vertical axis in FIG. 14, and a slight loss of synchronization is determined based on an amount of change of the value X of the counter C when the motor flag 152*c* passes by the motor HP sensor 153. For example, referring to FIG. 14, the value (X=0) at (xiii) and the value (X=10) at (xvi) may be compared.

According to a third embodiment, the counter C is configured to count a value Y corresponding to angle pulses for rotating the stepping motor 155 during a period from a time when the pressure belt 120 is placed at an angle changing position to a time when the motor flag 152*c* passes by the motor HP sensor 153. The CPU 10 then determines a slight loss of synchronization based on the amount of change of the value Y of the counter C. For example, referring to FIG. 14, the count value (Y=100) in (xii) to (xiii) and the count value (Y=110) in (xv) to (xvi) may be compared.

More specifically, the following processing is to be performed. The CPU 10 uses the counter C to count the value Y corresponding to the angle pulses for rotating the stepping motor 155 during a period from a time when the sensor unit 150 detects that the pressure belt 120 is placed at an angle changing position to a time when the motor flag 152*c* passes by the motor HP sensor 153. The CPU 10 in the sequence for determining a slight loss of synchronization determines that a slight loss of synchronization has occurred if an absolute value of a difference between the value Y counted immediately before the determination sequence and a value $Y_0$ counted immediately before the last determination sequence. If the absolute value of a difference between the value Y counted immediately before the determination sequence and a value $Y_0$ counted immediately before the last determination sequence is not higher than the threshold value, the CPU 10 determines that a slight loss of synchronization has not occurred. Because the rest of the configuration is the same as that of the first embodiment, any repetitive description will be omitted.

Having described that, according to this embodiment, start of counting by the counter C is triggered by detection by the sensor unit 150 that the pressure belt 120 is placed at an angle changing position, the counting may be started at an earlier time. For example, referring to FIG. 14, a count value in (x) to (xiii) (through (xi) and (xii) where Y=200) and a count value in (xiii) to (xvi) (through (xiv) and (xv) where Y=210) may be compared.

According to this embodiment, irrespective of the direction of rotation of the stepping motor 155, the value Y of the counter C when the motor flag 152*c* passes by the motor HP sensor 153 is compared with the value $Y_0$ of the counter C when the motor flag 152*c* passes by the motor HP sensor 153 last time. However, the counting may be performed for each of the directions of rotation of the stepping motor 155. For example, referring to FIG. 14, the count value (YC=100) in (ix) to (x) and the count value (YC=110) in (xv) to (xvi) may be compared.

More specifically, the counter C counts a value YC corresponding to angle pulses for rotating the stepping motor 155 in the CW direction during a period from a time of detection that the pressure belt 120 is placed at an angle changing position to a time when the motor flag 152*c* passes by the motor HP sensor 153. A counter D counts a value YD corresponding to angle pulses for rotating the stepping motor 155 in the CCW direction during a period from a time of detection that the pressure belt 120 is placed at an angle changing position to a time when the motor flag 152*c* passes by the motor HP sensor 153. In a slight loss of synchronization determination sequence, the CPU 10 determines that a slight loss of synchronization has occurred in a case where the absolute value of a difference between the value YC counted immediately before the determination sequence and a value $YC_0$ counted immediately before the last determination sequence based on the counter C exceeds a threshold value. The same is true for the counter D.

According to this embodiment, the determination of a slight loss of synchronization is based on a result of a comparison between the value Y counted immediately before the determination sequence and the value $Y_0$ counted immediately before the last determination sequence. However, a value counted immediately before the first determination sequence may be defined as $Y_0$. In other words, the CPU 10 in a determination sequence for a slight loss of synchronization may determine that a slight loss of synchronization has occurred in a case where the absolute value of a difference between the value Y counted immediately before the determination sequence and the value $Y_0$ counted immediately before the first determination sequence exceeds a threshold value. For example, referring to FIG. 14, a count value (Y=100) in (iv) to (v) and a count value (Y=110) in (xv) to (xvi) may be compared.

According to this embodiment, a determination sequence for a slight loss of synchronization may compare a value Y counted immediately before the determination sequence and an average value $Y_0$ of a plurality of determination operations. A process for operating the stepping motor 155 for determining $Y_0$ may be performed before the pressure belt 120 starts rotating (such as between S107 and S108 in FIG. 1).

More specifically, the CPU 10 repeats the following operations (I) to (IV) a plurality of number of times and obtains a plurality of values Y of the counter C. The CPU 10 stores an average value of the obtained plurality of values Y as $Y_0$ in the RAM 600 and, in a determination sequence, compares it with the value $Y_0$ determined in the processing to determine a slight loss of synchronization.

(I) The stepping motor 155 is rotated in the CW direction for angle pulses equal to those for a steering operation after the motor HP sensor 153 is changed to have an OFF state and is then stopped.

(II) The stepping motor 155 is rotated in the CCW direction until the motor HP sensor 153 is changed to have an ON state and obtains a value Y of the counter C when the motor HP sensor 153 is changed to have an ON state.

(III) The stepping motor 155 is rotated in the CCW direction for angle pulses equal to those for the steering operation after the motor HP sensor 153 is changed to have an ON state and is then stopped.

(IV) The stepping motor 155 is rotated in the CW direction until the motor HP sensor 153 is changed to have an ON state, and a value Y of the counter C when the motor HP sensor 153 is changed to have an OFF state is obtained.

For example, in a case where an average value of four rotating operations irrespective of the direction of rotation of the stepping motor 155 is $Y_0$, the CPU 10 may repeat the operations (I) to (IV) twice to obtain four values X. The CPU 10 may determine the average value of the obtained four values Y as $Y_0$.

The configuration of this embodiment can also provide similar effects to those of the first embodiment.

Fourth Embodiment

According to the third embodiment, the counter C counts a value Y corresponding to angle pulses for rotating the stepping motor 155 during a period from a time when the pressure belt 120 is placed at an angle changing position to a time when the motor flag 152*c* passes by the motor HP sensor 153. The CPU 10 then determines a slight loss of synchronization based on an amount of change in value Y of the counter C. For example, referring to FIG. 14, a count value (Y=100) in (xii) to (xiii) and a count value (Y=110) in (xv) to (xvi) may be compared.

According to a fourth embodiment, the CPU 10 may determine a slight loss of synchronization based on whether the value Y of the counter C exceeds a threshold value or not. In other words, instead of an amount of change in value Y of the counter C, the value Y of the counter C is directly used for determination of a slight loss of synchronization.

Here, the threshold value may be prestored in the RAM 600 or the ROM 601. The CPU 10 uses the counter C to count the value Y corresponding to angle pulses for rotating the stepping motor 155 during a period from a time of detection by the sensor unit 150 that the pressure belt 120 is placed at an angle changing position to a time when the motor flag 152*c* passes by the motor HP sensor 153. The CPU 10 in a determination sequence for a slight loss of synchronization determines that a slight loss of synchronization has occurred if the value Y counted immediately before the determination sequence exceeds the threshold value prestored in the RAM 600 or the ROM 601. The CPU 10 in a determination sequence for a slight loss of synchronization determines that a slight loss of synchronization has not occurred if the value Y counted immediately before the determination sequence is not higher than the threshold value prestored in the RAM 600 or the ROM 601.

Because the rest of the configuration is the same as that of the second embodiment, any repetitive description will be omitted.

The configuration of this embodiment can also provide similar effects to those of the first embodiment.

Fifth Embodiment

According to the first to fourth embodiments, the CPU 10 determines occurrence of a slight loss of synchronization based on an output from the motor HP sensor 153 and an amount of change or an absolute value of a value of a counter configured to count an amount of rotation of the rotor unit 155*a* instructed by the CPU 10 and notifies occurrence of an error if any.

According to a fifth embodiment, the CPU 10 determines occurrence of a slight loss of synchronization based on an output of the motor HP sensor 153 and a time for placing the tension roller 122 from a reference position to a predetermined position.

This embodiment will be described with focus on differences from the first embodiment, and any repetitive descriptions regarding the first and fifth embodiments will be omitted.

The image forming apparatus 1 according to this embodiment includes a timer 604 (FIG. 13) electrically connected to the CPU 10. The timer 604 functions as a time measuring unit configured to measure a time period from a time when the CPU 10 outputs an instruction to rotate the rotor unit 155*a* in a predetermined direction to a time when it is detected that the tension roller 122 is placed at a predetermined position in a steering operation. Here, the position of the tension roller 122 is detected by a motor HP sensor (detecting unit) 153.

The same control for reciprocally moving the belt, steering operations, and detecting method in the motor HP sensor as those of the first embodiment are applied here.

DETECTING METHOD FOR SLIGHT LOSS OF SYNCHRONIZATION

Like the first embodiment described with reference to FIG. 14, when a slight loss of synchronization occurs, the CPU 10 instructs more angle pulses (number of pulses) than normal in (xv) to (xvi) in FIG. 14. The period (xv) to (xvi) in FIG. 14 corresponds to a period from a time when the stepping motor 155 starts rotating in the CW direction to a time when the motor HP sensor 153 detects passage through the motor flag 152*c*. Like the first embodiment, the CPU 10 causes the stepping motor 155 in the CCW direction for predetermined pulses (100 pulses in the first embodiment) from a time when the motor HP sensor 153 detects a home position and then stops the rotation of the stepping motor 155. Therefore, the tension roller 122 moves by substantially equal distances at all times in reciprocal movement during a steering operation from the position of the tension roller 122 when the stepping motor 155 starts rotating in the CW direction to the position of the tension roller 122 when the motor HP sensor 153 detects passage of the motor flag 152*c*.

Here, when the CPU 10 inputs pulse signals having an equal pulse frequency to the motor driver 180, the stepping motor 155 can rotate at an equal speed. In other words, when the stepping motor 155 is rotated at an equal speed, the time for moving the tension roller 122 by a certain distance increases as the number of pulses of pulse signals to be designated to the motor driver 180 increases.

According to this embodiment, the timer 604 is provided which is configured to measure a time period from a time when the CPU 10 outputs an instruction to rotate the rotor unit 155*a* in a predetermined direction to a time when it is detected that the tension roller 122 is placed at a predetermined position. A time period measured by the timer 604 is stored in a part of a storage region in the RAM 600. The CPU 10 compares the time period measured by the timer 604 with the corresponding time period in the last steering operation and determines that a slight loss of synchronization has occurred if the amount of change exceeds a predetermined value.

If the signal from the motor HP sensor 153 does not change even after a lapse of a predetermined period from transmission of a rotation command to the stepping motor 155, the CPU 10 determines that the stepping motor 155 is not rotating (or that a complete loss of synchronization has occurred). The predetermined period is set longer than a time period assumed as a time period from transmission of a rotation command to the stepping motor 155 to detection by the motor HP sensor 153 in a normal case and in a case with a slight loss of synchronization.

Specific Control

Next, with reference to FIG. 14 according to the first embodiment, a specific control over a steering operation from start of rotation of the pressure belt 120 to an error stop will be described according to the fifth embodiment. The image forming apparatus 1, like the first embodiment, causes the pressure belt 120 to rotate and at the same time performs a steering operation to perform a reciprocal movement control over the pressure belt 120.

The pressure belt 120 after starting to rotate starts laterally deviating toward one side in the lateral direction while the pressure belt 120 is rotating. It is assumed here that the pressure belt 120 is laterally deviating to the front side.

When the belt position sensor 150*a* is changed to have an OFF state, the pressure belt 120 is placed at a front side angle changing position (−1.5 mm). In order to move the pressure belt 120 to the back side after the belt position sensor 150*a* is changed to have an OFF state (FIG. 14, (i)), the CPU 10 transmits a command to the stepping motor 155 to rotate in the CCW direction.

The CPU 10 causes the stepping motor 155 to rotate in the CCW direction by transmitting a command to the motor driver 180 every pulse (FIG. 14, (i) to (ii)) until the motor HP sensor 153 is changed to have an ON state.

If the motor HP sensor 153 does not react (or keeps its OFF state) within a predetermined period (such as within 0.5 sec) from the start of rotation, the image forming apparatus 1 performs an error stop like S205 in FIG. 2 according to the first embodiment. For the error stop, the image forming apparatus 1 inhibits the fixing device 100 from operating unless the malfunction is solved.

The CPU 10 transmits a command to the stepping motor 155 with reference to an instance when the motor HP sensor 153 is switched to an ON state at (ii) in FIG. 14. More specifically, the CPU 10 transmits to the stepping motor 155 a command to rotate for predetermined angle pulses (such as 100 pulses) in the CCW direction and a command to stop after the stepping motor 155 rotates for the predetermined angle pulses.

The steering operation tilts the tension roller 122 for moving the pressure belt 120 to the back side. Thus, the pressure belt 120 laterally deviates to the back side while rotating (FIG. 14, (iii) to (iv)).

After the pressure belt 120 rotates for a while, the pressure belt 120 is placed at a back side angle changing position (+1.5 mm) (FIG. 14, (iv)). The belt position sensor 150*b* is switched from an ON state to an OFF state. When the belt position sensor 150*b* is changed to have an OFF state, the CPU 10 transmits a command to rotate the stepping motor 155 in the CW direction to move the pressure belt 120 toward the front side. In response to the change of the belt position sensor 150*b* to have an OFF state or in response to a command to rotate the stepping motor 155 in the CW direction from the CPU 10, the timer 604 starts measuring time (FIG. 14, (iv)). The CPU 10 functions as an output unit configured to output a signal for instructing an amount of rotation of the rotor unit 155*a* and a signal for instructing the direction of rotation of the rotor unit 155*a*.

The CPU 10 transmits a command to the motor driver 180 every pulse until the motor HP sensor 153 is changed to have an OFF state and causes the stepping motor 155 to rotate in the CW direction (FIG. 14, (iv) to (v)). The timer 604 measures the time period (iv) to (v).

If the motor HP sensor 153 does not react (or keeps its ON state) within a predetermined period (such as within 0.5 sec) from the start of rotation, the image forming apparatus 1 performs an error stop like S205 in FIG. 2 according to the first embodiment. For the error stop, the image forming apparatus 1 inhibits the fixing device 100 from operating unless the malfunction is solved.

The CPU 10 stores the time period Z measured by the timer 604 in a predetermined region in the RAM 600 in response to the change of the motor HP sensor 153 to have an OFF state at (v) in FIG. 14.

The CPU 10 then performs a sequence for determining a slight loss of synchronization. The sequence for determining a slight loss of synchronization will be described below.

The CPU 10 transmits a command to the stepping motor 155 with reference to an instance when the motor HP sensor 153 is switched to an OFF state at (v) in FIG. 14. More specifically, the CPU 10 transmits to the stepping motor 155 a command to rotate for predetermined angle pulses (such as 100 pulses) in the CW direction and a command to stop after the stepping motor 155 rotates for the predetermined angle pulses.

The steering operation tilts the tension roller 122 for moving the pressure belt 120 to the front side. Thus, the pressure belt 120 laterally deviates to the front side while rotating (FIG. 14, (vi) to (vii)).

By repeating this flow, the CPU 10 performs reciprocal movement control over the pressure belt 120.

The timer 604 in the repeated steering operations repeatedly measures a time of the period corresponding to the period (iv) to (v) in FIG. 14. For example, the time of the period in (ix) to (x) in FIG. 14 and the time of the period (xv) to (xvi) in FIG. 14 may be measured.

Detection Sequence for Slight Loss of Synchronization

Because the determination sequence for a slight loss of synchronization can be understood by replacing the value X of the counter C by the time period Z measured by the timer 604 referring to FIG. 3 according to the first embodiment, any repetitive detail description will be omitted. That is, the CPU 10 calculates an amount of change $\Delta Z$ ($\Delta Z=|Z-Z_0|$) between the time period Z measured by the timer 604 and a time period $Z_0$ measured by the timer 604 last time and determines whether the amount of change $\Delta Z$ exceeds a threshold value or not.

If the amount of change $\Delta Z$ exceeds the threshold value, the CPU (notifying unit) 10 determines that a slight loss of synchronization has occurred and notifies the occurrence of an error.

The error notification may be performed in the same manner as that of the first embodiment. Even if a slight loss of synchronization has occurred, the CPU 10 does not stop the operation of the image forming apparatus 1. In other words, the rotation of the pressure belt 120 is not stopped in the fixing device 100. In other words, the CPU 10 functioning as a motor control unit controls the drive motor 603 to keep the pressure belt 120 rotating.

The configuration of this embodiment can also provide the same effects as those of the first to fourth embodiments.

Other Configuration Relating to Fifth Embodiment

Having described that the CPU 10 determines a slight loss of synchronization in a case where an amount of change $\Delta Z$ between the time period Z measured by the timer 604 and the time period $Z_0$ measured by the timer 604 last time exceeds a threshold value, the following configuration may be applied instead.

For example, a slight loss of synchronization may be determined if the amount of change $\Delta Z$ between a time period Z measured by the timer 604 and a time period $Z_0$ measured by the timer 604 in the first steering operation of a series of steering operations exceeds a threshold value. For example, referring to FIG. 14, a time period in (iv) to (v) and a time period in (xv) to (xvi) may be compared. In order to determine a time period $Z_0$, a process for causing the stepping motor 155 to operate may be performed before the pressure belt 120 starts rotating so that an average value of a plurality of operations can be determined as $Z_0$.

Having described above that the timer 604 measures a time period in a case where the stepping motor 155 is rotated in the CW direction, the timer 604 may measure a time period when the stepping motor 155 is rotated in the CCW direction, for example. More specifically, the timer 604 may measure a time of the period corresponding to (i) to (ii) in FIG. 14. In this case, the amount of change $\Delta Z$ may be obtained between periods with an equal direction of rotation, or the amount of change $\Delta Z$ may be obtained between periods with different directions of rotation.

Having described that, according to this embodiment, whether the amount of change $\Delta Z$ exceeds a threshold value or not is determined, the CPU 10 may determine a slight loss of synchronization if the absolute value of the time period Z measured by the timer 604 exceeds a threshold value. In this case, the threshold value for the time period Z is set shorter than the threshold value (such as within 0.5 sec) for an error stop in S204, S205 in FIG. 2 according to the first embodiment.

Sixth Embodiment

According to the first to fifth embodiments, the reciprocal movement control over the pressure belt 120 has been described with regard to the control for reciprocally moving the belt, steering operations, and the determination for a slight loss of synchronization. An embodiment of the present disclosure may be applied to the heating belt 130.

In other words, the control for reciprocally moving the belt, steering operation, and determination for slight loss of synchronization exemplarily described with respect to the pressure belt 120 are applicable to a case where at least one of the heating rotating member and the pressure rotating member forming the fixing nip portion N includes an endless belt.

Detail descriptions regarding application to the heating belt 130 of the control for reciprocally moving the belt, steering operations, and determination for slight loss of synchronization will be omitted. The pressure belt 120 may be replaced by the heating belt 130 to understand the applicability regarding the control for reciprocally moving the belt, steering operation, and determination for slight loss of synchronization according to the first to fifth embodiments.

For example, in a case where, like the first to fifth embodiments, both of the heating rotating member and the pressure rotating member are belt rotating members, the control for reciprocally moving the belt, steering operation, and determination for slight loss of synchronization may be applied to both of the heating belt 130 and the pressure belt 120.

Having described that, for example, according to the first to fifth embodiments, both of the heating rotating member and pressure rotating member forming the fixing nip portion N are belt rotating members (heating belt 130 and pressure belt 120), one of them may be a belt rotating member.

For example, as illustrated in FIG. 10, the heating rotating member may be a heating roller (rotating member) 510, and the pressure rotating member may be a pressure belt 520 being an endless belt rotating member. The heating roller 510 may be a hollow metal roller, for example, and may have an elastic layer and a separation layer in its surface layers. The heating roller 510 may internally contain a heater 512 configured to heat the heating roller 510. The pressure belt 520 is put across such that two rollers of the pressing roller 522 being a part of the fixing nip portion N and a tension roller 523 configured to apply tension to the pressure belt 520 can be circularly rotated. The pressure belt 520 internally contains a nip pad 524 being a part of the fixing nip portion N. The tension roller 523 may also work as a steering roller for performing steering operations.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-241332 filed Dec. 13, 2016 and No. 2017-194426 filed Oct. 4, 2017, which are hereby incorporated by reference herein in their entirety.

What is claimed is:

1. An image forming apparatus comprising:

an image forming unit configured to form a toner image on a recording medium;

a rotating member;

an endless belt configured to form, in cooperation with the rotating member, a nip portion configured to fix the toner image formed by the image forming unit to the recording medium;

a first roller and a second roller configured to rotatably support the belt;

a stepping motor;

a drive transmitting unit configured to transmit drive of the stepping motor to the first roller so as to tilt the first roller;

an output unit configured to output an amount-of-rotation signal instructing an amount of rotation of a rotor in the stepping motor;

an electric current control unit configured to control electric current to be fed to a coil in the stepping motor based on the amount-of-rotation signal output from the output unit;

a measuring unit configured to measure an amount of rotation of the stepping motor based on the amount-of-rotation signal;

a detecting unit configured to detect a position of the endless belt; and a notifying unit configured to display a notification to issue a warning regarding the stepping motor in a case where a predetermined difference or greater arises between the amount of rotation of the stepping motor measured by the measuring unit and the amount of rotation of the stepping motor based on the amount-of-rotation signal in a state that an image formation process is able to be executed and to display a warning that the image formation process is unable to be executed in a case where a home position sensor of the stepping motor is not switched from on to off or from off to on within a predetermined time period.

2. The image forming apparatus according to claim 1, wherein the output unit outputs the amount-of-rotation signal and a rotation direction signal instructing a rotation direction of the rotor such that a first period, a second period, a third period and a fourth period is able to be repeated in this order, in the first period, the rotor is rotated by a predetermined amount of rotation in a first rotation direction from a state having the first roller placed at a predetermined position;

in the second period, the rotor is rotated in a second rotation direction opposite to the first rotation direction from a position having the first roller moved by drive of the stepping motor in the first period until the detecting unit detects that the first roller is placed at the predetermined position;

in the third period, the rotor is further rotated in the second rotation direction; and in the fourth period, the rotor is rotated in the first direction until the first roller is placed at a predetermined position;

wherein the electric current control unit controls electric current to be fed to the coil based on the amount-of-rotation signal output from the output unit and the rotation direction signal;

wherein the measuring unit measures the amount of rotation instructed by the output unit in at least the second period; and wherein the notifying unit provides the predetermined notification when an amount of change of the amount of rotation measured by the measuring unit exceeds a threshold value.

3. The image forming apparatus according to claim 1, wherein the output unit outputs the amount-of-rotation signal and a rotation direction signal instructing a rotation direction of the rotor such that a first period, a second period, a third period and a fourth period is able to be repeated in this order, in the first period, the rotor is rotated by a predetermined amount of rotation in a first rotation direction in response to detection by the detecting unit that the first roller is placed at a predetermined position;

in the second period, the rotor is rotated in a second rotation direction opposite to the first rotation direction from a position having the first roller moved by drive of the stepping motor in the first period until the detecting unit detects that the first roller is placed at the predetermined position;

in the third period, the rotor is rotated by a predetermined amount of rotation in the second rotation direction in response to detection by the detecting unit that the first roller is placed at the predetermined position; and in the fourth period, the rotor is rotated in the first rotation direction until the detecting unit detects that the first roller is placed at the predetermined position from a position having the first roller moved by drive of the stepping motor in the third period;

wherein the measuring unit measures the amount of rotation instructed by the output unit in at least the second period; and wherein the notifying unit provides the predetermined notification when an amount of change of the amount of rotation measured by the measuring unit exceeds a threshold value.

4. The image forming apparatus according to claim 1, wherein the output unit outputs the amount-of-rotation signal and a rotation direction signal instructing a rotation direction of the rotor such that a first period, a second period, a third period and a fourth period is able to be repeated in this order, in the first period, the rotor is rotated by a predetermined amount of rotation in a first rotation direction from a state having the first roller placed at a predetermined position;

in the second period, the rotor is rotated in a second rotation direction opposite to the first rotation direction from a position having the first roller moved by drive of the stepping motor in the first period until the detecting unit detects that the first roller is placed at the predetermined position;

in the third period, the rotor is further rotated in the second rotation direction; and in the fourth period, the rotor is rotated in the first direction until the first roller is placed at a predetermined position;

wherein the electric current control unit controls electric current to be fed to the coil based on the amount-of-rotation signal output from the output unit and the rotation direction signal;

wherein the measuring unit measures the amount of rotation instructed by the output unit in at least the second period; and wherein the notifying unit provides the predetermined notification when the amount of rotation measured by the measuring unit exceeds a threshold value.

5. The image forming apparatus according to claim 1, wherein the output unit outputs the amount-of-rotation signal and a rotation direction signal instructing a rotation direction of the rotor such that a first period, a second period, a third period and a fourth period is able to be repeated in this order, in the first period, the rotor is rotated by a predetermined amount of rotation in a first rotation direction in response to detection by the detecting unit that the first roller is placed at a predetermined position;

in the second period, the rotor is rotated in a second rotation direction opposite to the first rotation direction from a position having the first roller moved by drive of the stepping motor in the first period until the detecting unit detects that the first roller is placed at the predetermined position;

in the third period, the rotor is rotated by a predetermined amount of rotation in the second rotation direction in response to detection by the detecting unit that the first roller is placed at the predetermined position; and in the fourth period, the rotor is rotated in the first rotation direction until the detecting unit detects that the first roller is placed at the predetermined position from a position having the first roller moved by drive of the stepping motor in the third period;

wherein the measuring unit measures the amount of rotation instructed by the output unit in at least the second period; and wherein the notifying unit provides the predetermined notification when the amount of rotation measured by the measuring unit exceeds a threshold value.

6. The image forming apparatus according to claim 1, further comprising:

a belt detecting unit configured to detect that the belt is off a predetermined zone in a lateral direction of the belt, wherein the output unit outputs a rotation direction signal to tilt the first roller in a direction enabling the belt to return to the predetermined zone based on an output from the belt detecting unit.

7. The image forming apparatus according to claim 1, further comprising:

an inhibiting unit configured to inhibit execution of the image formation process in a case where the detecting unit does not detect that the first roller is placed at a predetermined position after a lapse of a predetermined period from a time when the output unit instructs the rotor to start rotating.

8. The image forming apparatus according to claim 1, further comprising:

a rotation control unit configured to control rotation of the belt, wherein the rotation control unit causes the belt to keep rotating in a case where the notifying unit provides the predetermined notification.

* * * * *